US011555299B2

(12) United States Patent
Buescher et al.

(10) Patent No.: US 11,555,299 B2
(45) Date of Patent: Jan. 17, 2023

(54) FAUCET SPOUT INCLUDING A SIDE OUTLET AND FLOW CONTROL FEATURES

(71) Applicant: Delta Faucet Company, Indianapolis, IN (US)

(72) Inventors: Alisha Nicole Buescher, Jamestown, IN (US); Gerald Robert Hayes, Lebanon, IN (US); Brian Wayne Johnson, Muncie, IN (US)

(73) Assignee: Delta Faucet Company, Indianapolis, IN (US)

( * ) Notice: Subject to any disclaimer, the term of this patent is extended or adjusted under 35 U.S.C. 154(b) by 117 days.

(21) Appl. No.: 17/001,837

(22) Filed: Aug. 25, 2020

(65) Prior Publication Data

US 2021/0062481 A1 Mar. 4, 2021

Related U.S. Application Data

(60) Provisional application No. 63/034,160, filed on Jun. 3, 2020, provisional application No. 62/892,855, filed on Aug. 28, 2019.

(51) Int. Cl.
*E03C 1/04* (2006.01)

(52) U.S. Cl.
CPC ..... *E03C 1/0404* (2013.01)

(58) Field of Classification Search
CPC ..... E03C 1/0404; E03C 1/08; E03C 1/084; E03C 1/086; E03C 2001/0414; E03C 2001/0416; E03C 2001/0417; B05B 1/18
See application file for complete search history.

(56) References Cited

U.S. PATENT DOCUMENTS

| | | | | |
|---|---|---|---|---|
| 2,524,956 | A | 10/1950 | Brunetti | |
| 2,585,997 | A | 2/1952 | Bruewer | |
| 6,352,183 | B1 | 3/2002 | Kristiansen et al. | |
| 6,412,782 | B1 | 7/2002 | Rivet et al. | |
| 8,573,258 | B2 * | 11/2013 | Lin | E03C 1/0404 239/592 |

(Continued)

FOREIGN PATENT DOCUMENTS

| | | | |
|---|---|---|---|
| CN | 106122523 | A | 11/2016 |
| CN | 108474198 | A | 8/2018 |

(Continued)

OTHER PUBLICATIONS

Ivy Chen, Vortex, retrieved from http://www.zevalife.com/news/, 1 page, at least as early as Jul. 2014.

*Primary Examiner* — Janie M Loeppke
(74) *Attorney, Agent, or Firm* — Bose McKinney & Evans LLP

(57) ABSTRACT

A faucet spout includes an arm extending from an upstream portion to a downstream portion. The arm defines a longitudinal axis extending between the upstream portion and the downstream portion. A passageway is disposed in the arm, and the passageway is configured to receive water from a water source. A plurality of baffles is disposed in the passageway. The plurality of baffles defines a tortuous flow path in the passageway. An outlet is disposed substantially perpendicularly to the longitudinal axis. The outlet is configured to receive water from the passageway and deliver water from the faucet spout.

27 Claims, 20 Drawing Sheets
(8 of 20 Drawing Sheet(s) Filed in Color)

(56) References Cited

U.S. PATENT DOCUMENTS

| | | | | |
|---|---|---|---|---|
| D737,941 | S | 9/2015 | Eads | |
| 9,220,376 | B2 * | 12/2015 | Ohashi | E03C 1/084 |
| D767,725 | S | 9/2016 | Eads | |
| D767,727 | S | 9/2016 | Eads | |
| D769,418 | S | 10/2016 | Eads | |
| D769,419 | S | 10/2016 | Eads | |
| 10,400,429 | B2 | 9/2019 | Eads et al. | |
| 11,214,947 | B2 | 1/2022 | Rosko et al. | |
| 2003/0006314 | A1 | 1/2003 | Chao | |
| 2005/0223490 | A1 | 10/2005 | Kunkel | |
| 2013/0291977 | A1 | 11/2013 | Chung | |
| 2018/0298595 | A1 | 10/2018 | Eads et al. | |
| 2020/0087901 | A1 | 3/2020 | Rosko et al. | |

FOREIGN PATENT DOCUMENTS

| | | | |
|---|---|---|---|
| CN | 109059294 | A | 12/2018 |
| CN | 109724451 | A | 5/2019 |
| EP | 1541241 | A1 | 6/2005 |
| EP | 2733269 | A1 | 5/2014 |
| WO | 2017070232 | A1 | 4/2017 |

* cited by examiner

FAUCET SPOUT INCLUDING A SIDE OUTLET AND FLOW CONTROL FEATURES

CROSS-REFERENCE TO RELATED APPLICATIONS

The present application claims priority to U.S. Provisional Patent Application Ser. No. 62/892,855, filed Aug. 28, 2019, and U.S. Provisional Patent Application Ser. No. 63/034,160, filed Jun. 3, 2020, the disclosures of which are expressly incorporated herein by reference.

BACKGROUND AND SUMMARY OF THE DISCLOSURE

The present disclosure generally relates to a faucet spout for delivering water. The present disclosure particularly relates to a faucet spout that includes a side outlet.

Aesthetic details are factors considered in the design of faucet spouts. Such details include the shape of faucet spout components and the shape and/or appearance of water streams discharged from faucet spouts. However, consideration of structural aesthetic details can adversely affect functional performance of faucet spouts. For example, faucet spouts including a structure delivering water in an aesthetically pleasing direction may deliver such water non-uniformly across the width of an outlet, which is less desirable from a functional perspective.

According to an illustrative embodiment of the present disclosure, a faucet spout includes an arm extending from an upstream portion to a downstream portion. The arm defines a longitudinal axis extending between the upstream portion and the downstream portion. A passageway is disposed in the arm, and includes an inlet configured to receive water from a water source. The inlet extends substantially parallel to the longitudinal axis. A plurality of baffles is disposed in the passageway. The plurality of baffles defines a tortuous flow path in the passageway. An outlet is disposed substantially perpendicularly to the longitudinal axis. The outlet is configured to receive water from the passageway and deliver water from the faucet spout.

According to another illustrative embodiment of the present disclosure, a faucet spout includes a passageway having an inlet portion configured to receive water from a water source and an outlet portion configured to receive water from the inlet portion. A plurality of baffles is disposed in the passageway. The plurality of baffles defines a tortuous flow path in the passageway. A longitudinal axis extends between the inlet portion and the outlet portion. An outlet is disposed substantially perpendicularly to the longitudinal axis. The outlet is configured to receive water from the outlet portion and deliver water from the faucet spout.

According to yet another illustrative embodiment of the present disclosure, a faucet spout includes a passageway having an inlet portion configured to receive water from a water source and an outlet portion configured to receive water from the inlet portion. A longitudinal axis extends between the inlet portion and the outlet portion. An outlet is disposed substantially perpendicularly to the longitudinal axis, and the outlet is configured to receive water from the passageway and deliver water from the faucet spout. A flow director is disposed in the passageway and defines a tortuous flow path in the passageway. The tortuous flow path includes a first segment in which water flows away from the outlet and a second segment in which water is received from the first segment and water flows toward the outlet.

Additional features and advantages of the present disclosure will become apparent to those skilled in the art upon consideration of the following detailed description of illustrative embodiments of the present disclosure.

BRIEF DESCRIPTION OF THE DRAWINGS

The patent or application file contains at least one drawing executed in color. Copies of this patent or patent application publication with color drawing(s) will be provided by the office upon request and payment of the necessary fee.

DETAILED DESCRIPTION OF THE DRAWINGS

The embodiments of the disclosure described herein are not intended to be exhaustive or to limit the disclosure to the precise forms disclosed. Rather, the embodiments described herein enable one skilled in the art to practice the disclosure.

Embodiments of faucet or delivery spouts according to the present disclosure may form part of faucet assemblies that are capable of being coupled to sink decks (not shown). In such assemblies, a faucet spout is in fluid communication with one or more control valves (for example, hot and cold water control valves—not shown) that are selectively actuated by one or more faucet handles (for example, hot and cold water handles coupled to the hot and cold water control valves, respectively—not shown). In one illustrative embodiment, a hot water control valve controls flow of hot water from a hot water source (illustratively, a hot water valve stop—not shown) in response to rotation of a hot water handle, while a cold water control valve controls flow of cold water from a cold water source (illustratively, a cold water valve stop—not shown) in response to rotation of a cold water handle. In another illustrative embodiment, a mixing valve (not shown) may control flow of hot water from a hot water source and flow of cold water from a cold water source in response to manipulation of a faucet handle. In some illustrative embodiments, valves may control other types of liquids including, for example, filtered or treated water.

Figure 1:
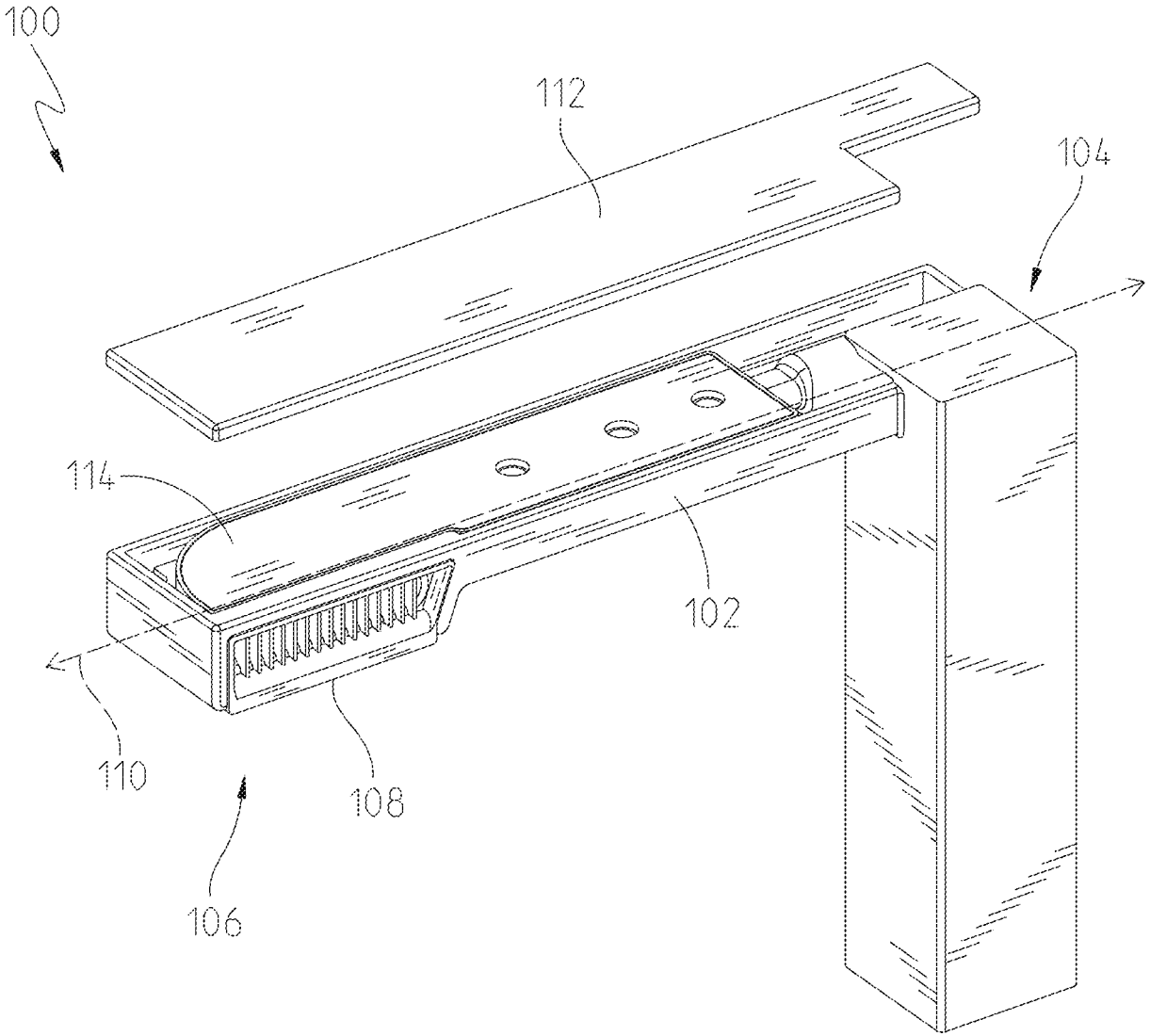
FIG. 1 is a partially exploded top perspective view of an illustrative faucet spout including a side outlet.

Referring initially to FIG. 1, an illustrative faucet spout 100 is shown. The faucet spout 100 may be formed of various appropriate materials, such as metals and plastics as described in further detail below. Generally, the faucet spout 100 includes an upwardly extending arm 102. The arm 102 couples to a mounting shank (not shown), and the mounting shank is capable of coupling to a mounting nut (not shown) for securing the faucet spout 100 to a sink deck (not shown). The mounting shank also couples to a fitting (not shown) that is capable of fluid communication with, for example, one or more control valves (not shown), one or more handles (not shown), and one or more valve stops (not shown) of a faucet assembly. Accordingly, the fitting facilitates providing water to the faucet spout 100.

With continued reference to FIG. 1, the upwardly extending arm 102 of the faucet spout 100 may be formed of various appropriate materials, such as a metal. The arm 102 illustratively has an inverted L-shape (e.g., illustratively having a vertical member (e.g., hub) and a horizontal member (e.g., cantilevered member)), although the arm 102 could alternatively have other general shapes, such as a curved shape. The arm 102 generally includes an upstream portion 104 and a downstream portion 106. At the upstream portion, the faucet spout 100 includes an inlet (shown elsewhere) for receiving water and extending substantially parallel to a longitudinal axis 110 (as used herein, "substantially parallel" and variations thereof being understood to mean parallel ±15 percent). At the downstream portion 106, the faucet spout 100 includes a side outlet 108 for delivering water therefrom. That is, the outlet 108 is disposed substantially perpendicularly to the longitudinal axis 110 of the faucet spout 100 generally extending between the upstream portion 104 and the downstream portion 106 (as used herein, "substantially perpendicular" and variations thereof being understood to mean perpendicular ±15 percent). Stated yet another way, the outlet 108 is configured to deliver water from the faucet spout 100 substantially perpendicularly relative to the longitudinal axis 110. The arm 102 also illustratively carries a top cover 112. The top cover 112 may be formed of various appropriate materials, such as a metal or wood. Illustratively, the top cover 112 and the arm 102 may comprise the same metal. The top cover 112 overlies an internal passageway cover 114. As described in further detail below, the internal passageway cover 114 defines, in part, an internal passageway (shown elsewhere) through which water flows from the upstream portion 104 to the downstream portion 106.

Figure 2:
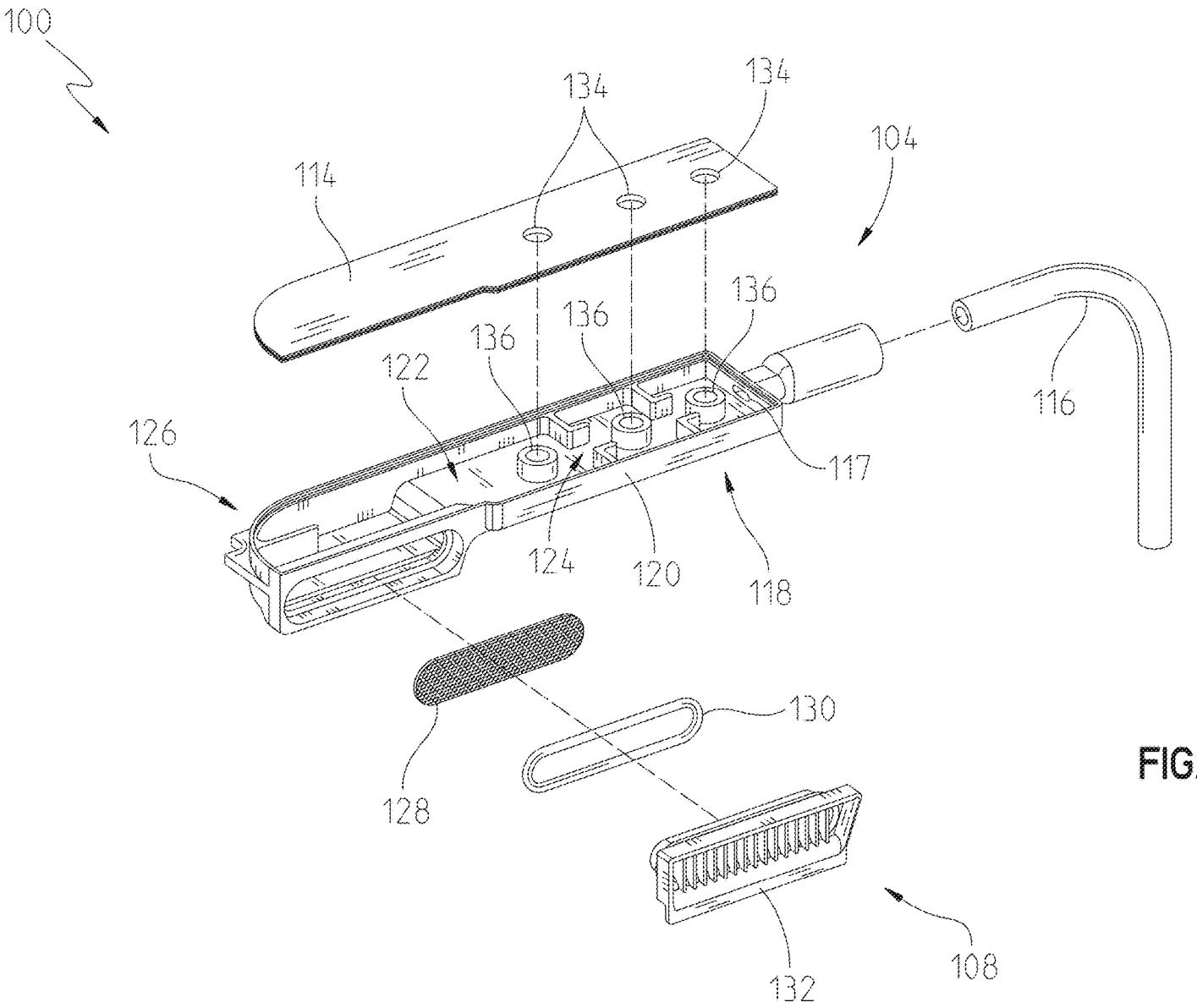
FIG. 2 is an exploded top perspective view of several components of the faucet spout of FIG. 1.

Referring to FIG. 2, several components of the faucet spout 100 are shown. At the upstream portion 104, the faucet spout 100 includes an inlet conduit 116 for receiving water from the fitting (not shown). The inlet conduit 116 couples to and delivers water to the inlet 117 at an inlet portion 118 of an internal passageway base 120. The internal passageway base 120 couples to the internal passageway cover 114. The internal passageway base 120 and the internal passageway cover 114 may be formed of various appropriate materials, such as a plastic, and the internal passageway base 120 may sealingly couple to the internal passageway cover 114, for example, via welding, one or more elastomers, or the like. The internal passageway base 120 and the internal passageway cover 114 define an internal passageway 122 through which water flows from the upstream portion 104 to the downstream portion 106. The internal passageway 122 includes a plurality of baffles 124 that reduces the velocity of water through the passageway 122 and facilitates directing flow in view of the presence of the side outlet 108. The baffles 124 and their effects on flow through the passageway 122 are described in further detail below. Downstream from the baffles 124, an outlet portion 126 of the internal passageway base 120 couples to the side outlet 108. The side outlet 108 includes a permeable screen 128, which may reduce velocity variations across outlet 108 and inhibit dripping from the outlet 108 by providing surface tension. The side outlet 108 further includes a seal 130 (illustratively, an O-ring) and an outlet cover 132. The outlet cover 132 may provide a drip edge and inhibit corrosion of any metal components of the faucet spout 100.

With continued reference to FIG. 2, the internal passageway cover 114 and the internal passageway base 120 illustratively include features for coupling to each other. Specifically, the internal passageway cover 114 includes one or more holes 134 that align with one or more holes 136 formed in the baffles 124. Each pair of holes 134, 136 may receive a fastener (not shown) to facilitate coupling the internal passageway cover 114 and the internal passageway base 120. Additionally or alternatively, one or both of the internal passageway cover 114 and the internal passageway base 120 may include external mounting features (not shown) for coupling to each other, the arm 102 (shown elsewhere), or the top cover 112 (shown elsewhere).

Figure 3A:
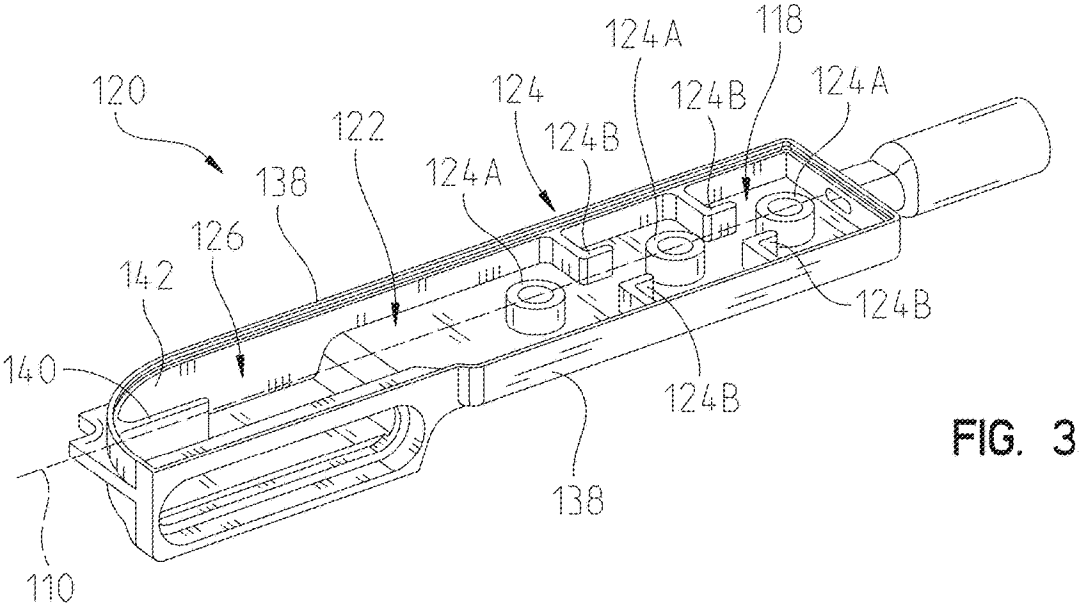
FIG. 3A is a top perspective view of an internal passageway base and a passageway of the faucet spout of FIG. 1.
Figure 3B:
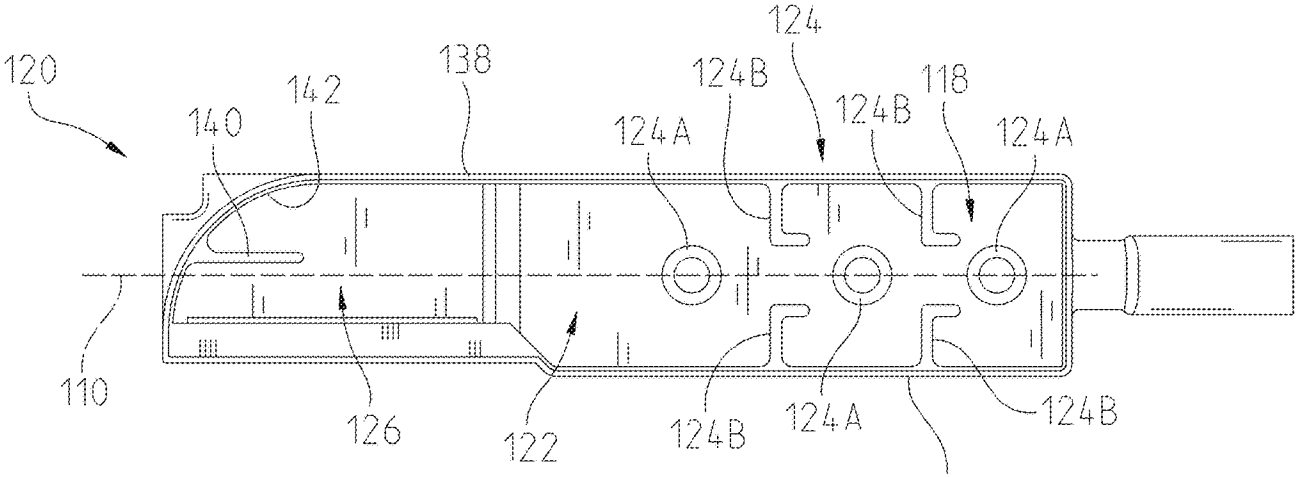
FIG. 3B is a top plan view of the internal passageway base and the passageway FIG. 3A.

Referring to FIGS. 3A and 3B, the internal passageway base 120 and the passageway 122 are shown. Generally and as briefly described above, the passageway 122 includes an inlet portion 118 configured to receive water from the inlet conduit 116 (shown elsewhere) and an outlet portion 126 configured to receive water from the inlet portion 118. The passageway 122 also includes a plurality of baffles 124 for controlling and directing flow within the passageway 122. The baffles 124 may take a variety of forms—that is, the baffles 124 may have a variety of shapes, sizes, and arrangements. For example, one or more baffles 124 may have a first shape, and one or more baffles 124 may have a second shape that is different than the first shape. More specifically and as illustrated, one or more baffles 124A may have a circular cross section and one or more baffles 124B an L-shaped cross section. In addition, baffles 124 having different shapes may be disposed in different locations relative to the center of the passageway 122. More specifically and as illustrated, the circular baffles 124A may be disposed at or near the center of the passageway 122 and the L-shaped baffles 124B may extend from sidewalls 138 of the passageway base 120. In addition, baffles 124 having different shapes may be interposed with each other. More specifically and as illustrated, the L-shaped baffles 124B may be interposed between the circular baffles 124A. As another example, one or more baffles 124, such as those described above, may be disposed at the inlet portion 118 and one or more baffles 124 may be disposed at the outlet portion 126. More specifically and as illustrated, the passageway 122 may include an outlet baffle 140 that extends substantially parallel relative to the longitudinal axis 110.

With continued reference to FIGS. 3A and 3B, the outlet portion 126 of the internal passageway 122 includes a flow directing wall 142 that directs flow toward the outlet 108 and/or reduces the velocity and directs water toward the outlet 108 (shown elsewhere). As illustrated, the flow directing wall 142 may have a curved shape. Alternatively, the flow directing wall 142 may have a flat shape.

Figure 4A:
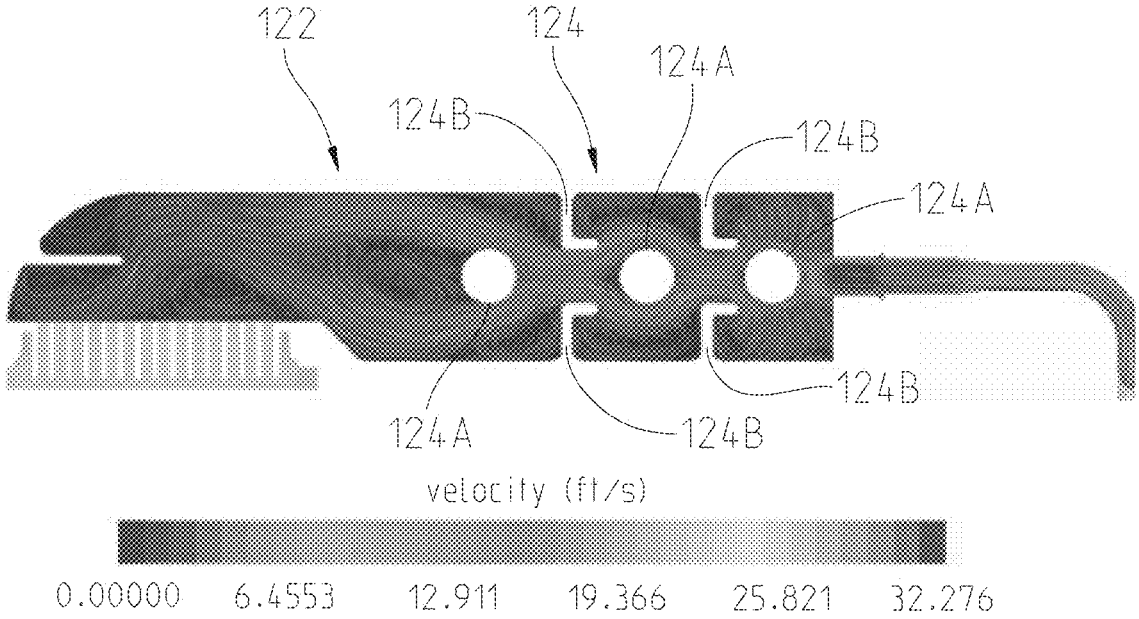
FIG. 4A is a velocity profile illustrating relative velocities of water at different locations in the internal passageway of the faucet spout of FIG. 1—for the velocity profiles illustrated herein, black and dark gray portions represent relatively low velocities, intermediate gray portions represent intermediate velocities, and light gray and white portions represent relatively high velocities; the velocity profiles illustrated herein include grayscale gradient keys associating grayscale colors (that is, colors ranging from black to white) with water velocities.
Figure 4B:
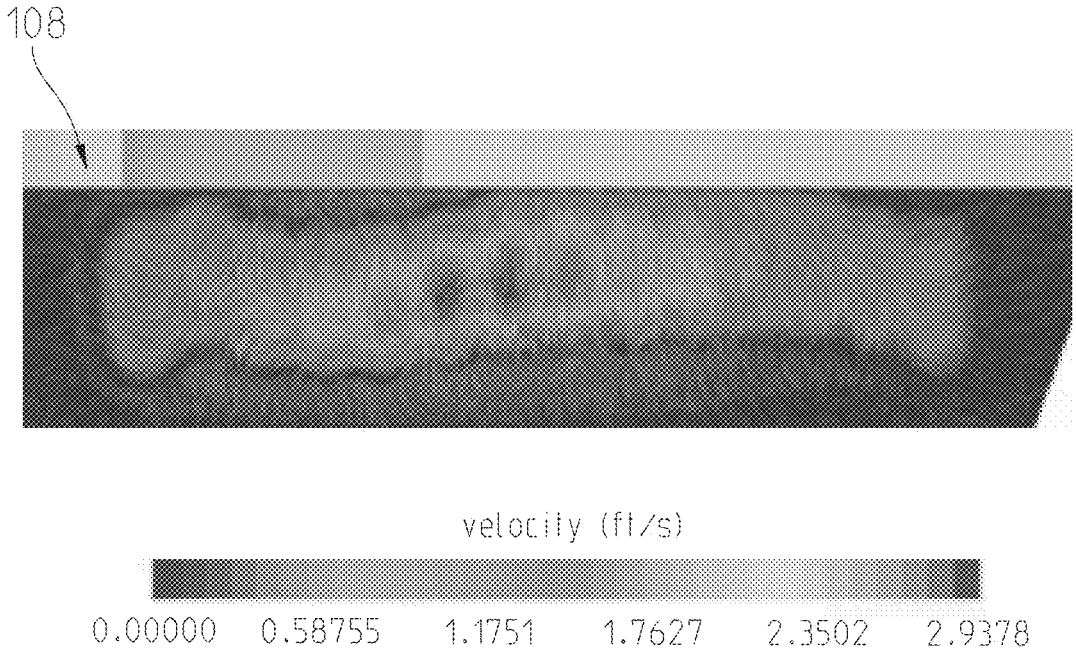
FIG. 4B is a velocity profile illustrating relative velocities of water at different locations across the face of an outlet of the faucet spout of FIG. 1.

FIGS. 4A and 4B are velocity profiles illustrating relative velocities of water at different locations in the internal passageway 122 and across the face of the outlet 108, respectively. For the velocity profiles illustrated herein, black and dark gray portions represent relatively low velocities, intermediate gray portions represent intermediate velocities, and light gray and white portions represent relatively high velocities. The velocity profiles illustrated herein include grayscale gradient keys associating grayscale colors (that is, colors ranging from black to white) with water velocities. As illustrated, water enters the internal passageway 122 at a relatively high velocity (for example, about 32 feet per second), and the baffles 124 reduce the velocity such that water is delivered from the outlet 108 at a relatively low and uniform velocity (for example, less than 3 feet per second with the highest rates near the center of the face of the outlet 108). In addition, FIG. 4A illustrates how the baffles 124 reduce the velocity by providing a relatively large surface area over which water moves and by creating various pockets of turbulent flow. Similarly, FIG. 4A illustrates how the baffles 124 define a tortuous flow path for water in the passageway 122. More specifically, the flow separates as water passes over the circular baffles 124A and recombines as water passes between the L-shaped baffles 124B.

Figure 5A:
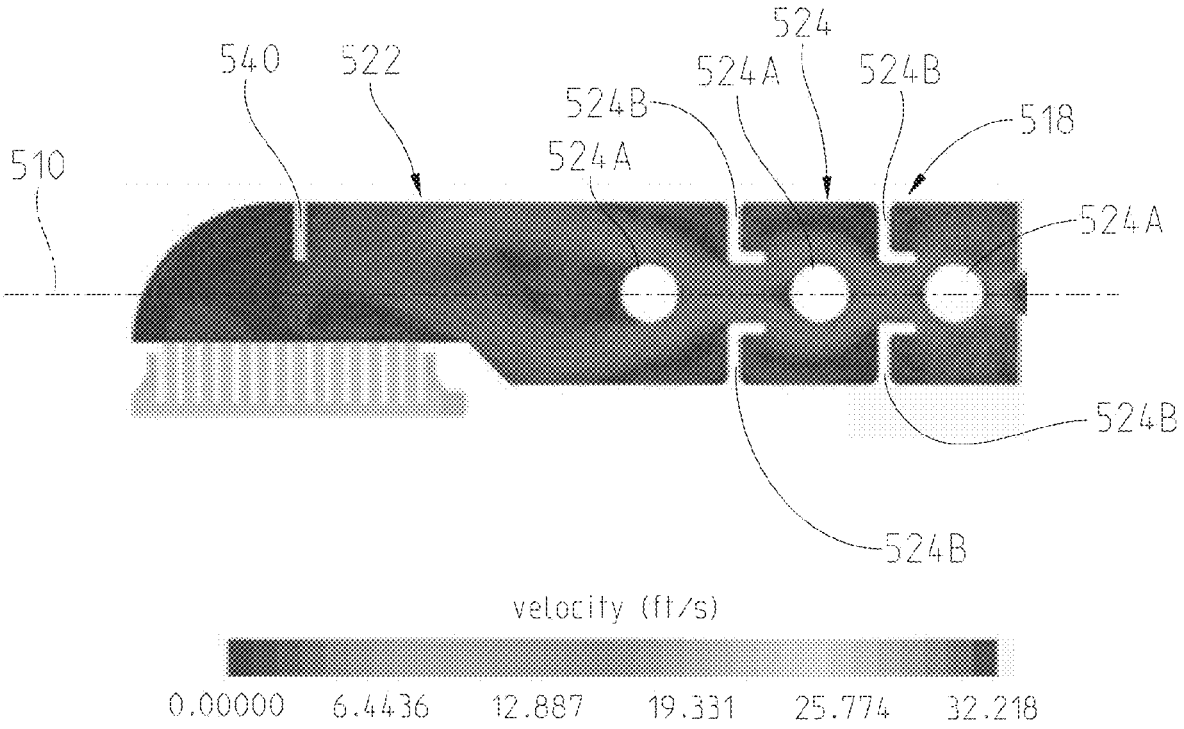
FIG. 5A is a velocity profile illustrating relative velocities of water at different locations in an internal passageway of another illustrative faucet spout.
Figure 5B:
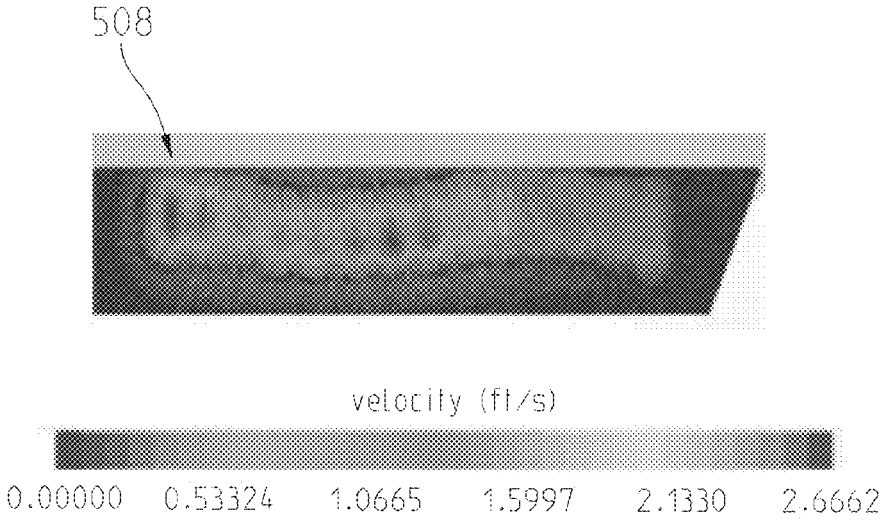
FIG. 5B is a velocity profile illustrating relative velocities of water at different locations across the face of an outlet in fluid communication with the internal passageway of FIG. 5A.

As described above, the baffles of faucet spouts according to the present disclosure may take a variety of forms. Another illustrative embodiment of a plurality of baffles 524 for an internal passageway 522 of a faucet spout, in addition to the associated velocity profile in the internal passageway 522, is shown in FIG. 5A. FIG. 5B shows the associated velocity profile across the face of an outlet 508 in fluid communication with the internal passageway 522. Many of the elements illustrated in FIGS. 5A and 5B are the same as the elements of the faucet spout 100 described above. As such, in the following description, like elements are identified with similar reference numbers. Generally, the internal passageway 522 includes circular baffles 524A and L-shaped baffles 524B at the inlet portion 518. The internal passageway 522 also includes an outlet baffle 540 that extends substantially perpendicularly relative to the longitudinal axis 510. As illustrated, water enters the internal passageway 522 at a relatively high velocity (for example, about 32 feet per second), and the baffles 524 reduce the velocity such that water is delivered from the outlet 508 at a relatively low and uniform velocity (for example, less than 3 feet per second with the highest rates near the center and the downstream-most side of the face of the outlet 508).

Figure 6A:
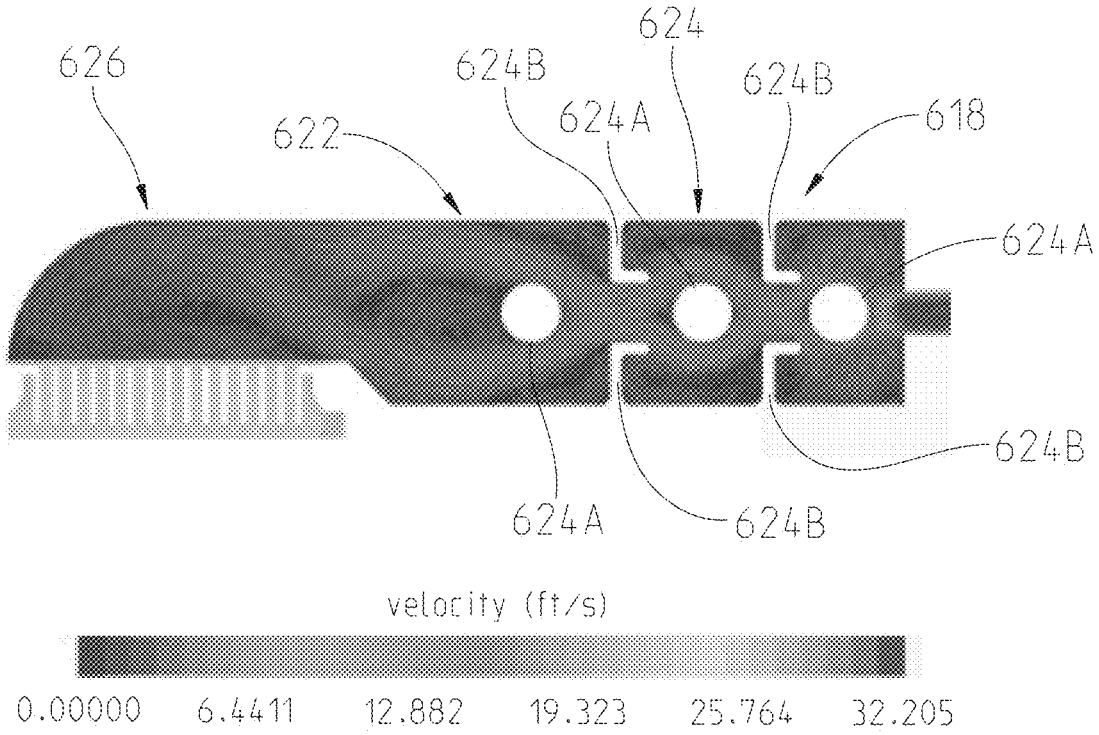
FIG. 6A is a velocity profile illustrating relative velocities of water at different locations in an internal passageway of another illustrative faucet spout.
Figure 6B:
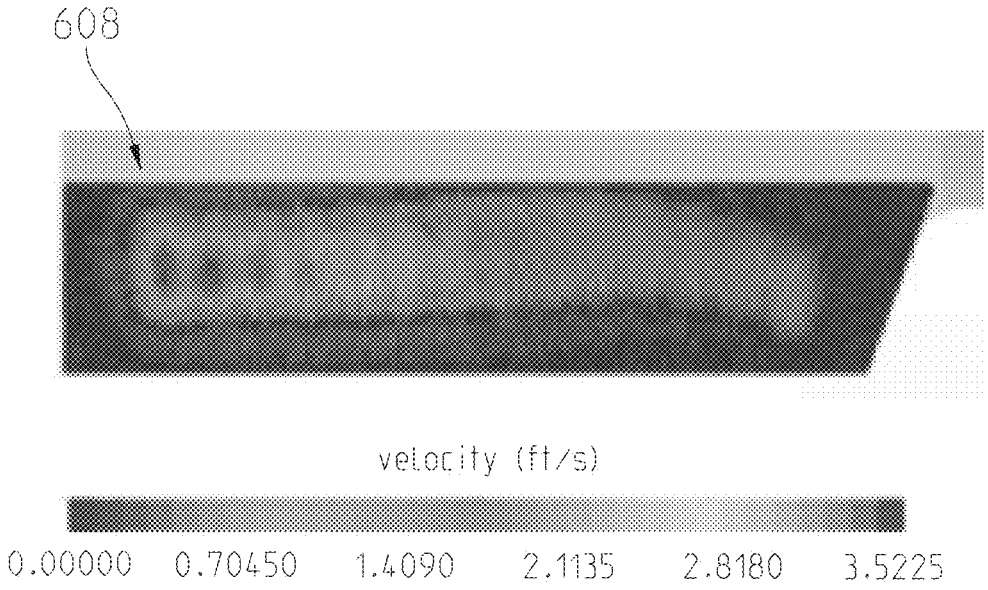
FIG. 6B is a velocity profile illustrating relative velocities of water at different locations across the face of an outlet in fluid communication with the internal passageway of FIG. 6A.

FIG. 6A shows another illustrative embodiment of a plurality of baffles 624 for an internal passageway 622 of a faucet spout, in addition to the associated velocity profile in the internal passageway 622. FIG. 6B shows the associated velocity profile across the face of an outlet 608 in fluid communication with the internal passageway 622. Many of the elements illustrated in FIGS. 6A and 6B are the same as the elements of the faucet spout 100 described above. As such, in the following description, like elements are identified with similar reference numbers. Generally, the internal passageway 622 includes circular baffles 624A and L-shaped baffles 624B at the inlet portion 618. However, the internal passageway 622 lacks an outlet baffle (such as the outlet baffle 140—shown elsewhere) at the outlet portion 626. As illustrated, water enters the internal passageway 622 at a relatively high velocity (for example, about 32 feet per second), and the baffles 624 reduce the velocity such that water is delivered from the outlet 608 at a relatively low and uniform velocity (for example, less than 3.6 feet per second with the highest rates near the downstream-most side of the face of the outlet 608).

Figure 7A:
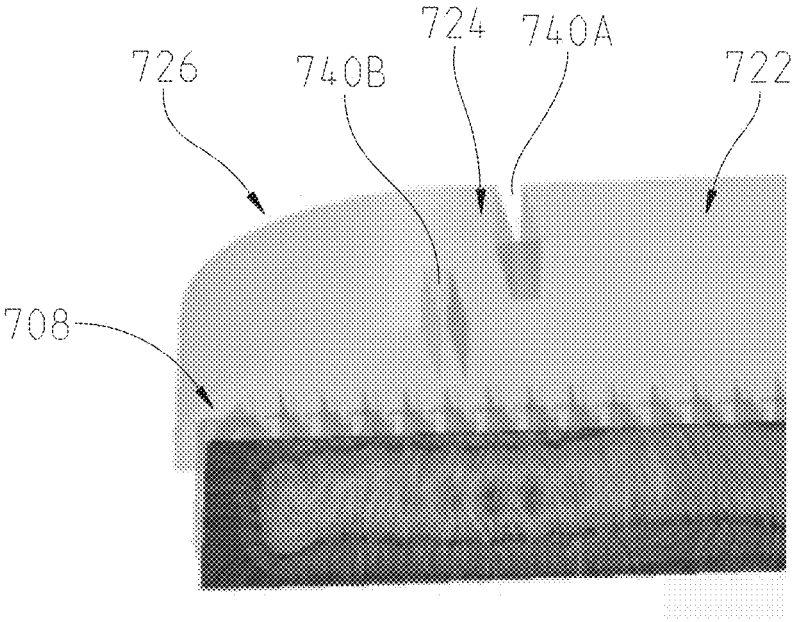
FIG. 7A is a velocity profile illustrating relative velocities of water at different locations across the face of an outlet of another illustrative faucet spout.
Figure 7B:
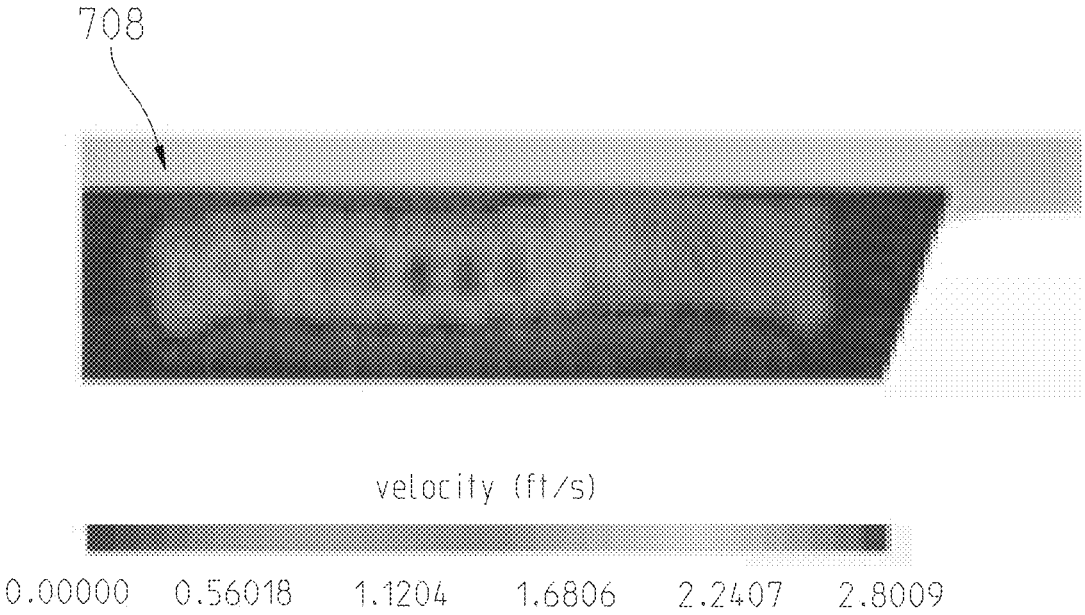
FIG. 7B is another velocity profile illustrating relative velocities of water at different locations across the face of the outlet of FIG. 7A.

FIG. 7A shows another illustrative embodiment of a plurality of baffles 724 for an outlet portion 726 of an internal passageway 722 of a faucet spout, in addition to the associated velocity profile across the face of an outlet 708 in fluid communication with the internal passageway 722. FIG. 7B also shows the velocity profile across the face of the outlet 708. The outlet portion 726 may be used with any of the inlet portions of internal passageways described herein. Many of the elements illustrated in FIGS. 7A and 7B are the same as the elements of the faucet spout 100 described above. As such, in the following description, like elements are identified with similar reference numbers. Generally, the internal passageway 722 also includes a first outlet baffle 740A and a second outlet baffle 740B at the outlet portion 726. As illustrated, the first outlet baffle 740A extends from an upper surface of the passageway 722 and the second outlet baffle 740B extends from a lower surface of the passageway 722. As illustrated, the baffles 740A and 740B reduce the velocity such that water is delivered from the outlet 708 at a relatively low and uniform velocity (for example, about 2.8 feet per second with the highest rates near the center of the face of the outlet 708).

Figure 8:
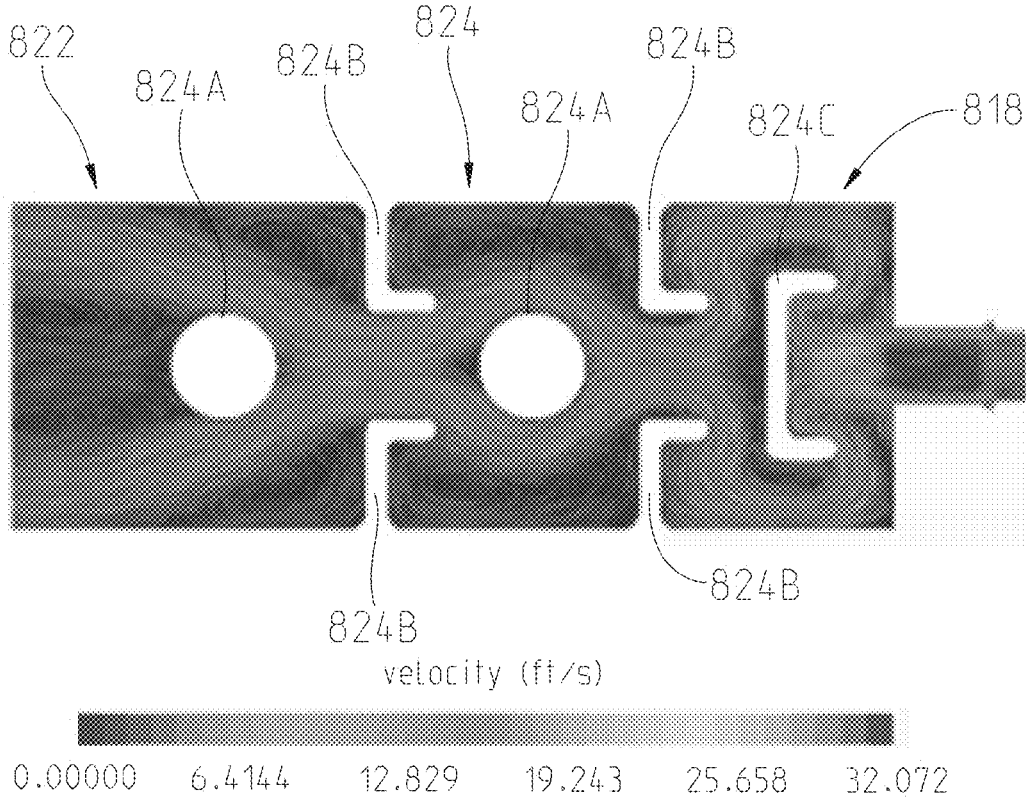
FIG. 8 is a velocity profile illustrating velocities of water at different locations in an inlet portion of an internal passageway of another illustrative faucet spout.

FIG. 8 shows another illustrative embodiment of a plurality of baffles 824 for an inlet portion 818 of an internal passageway 822 of a faucet spout, in addition to the associated velocity profile in the internal passageway 822. The inlet portion 818 may be used with any of the outlet portions of internal passageways described herein. Many of the elements illustrated in FIG. 8 are the same as the elements of the faucet spout 100 described above. As such, in the following description, like elements are identified with similar reference numbers. Generally, the internal passageway 822 includes circular baffles 824A and L-shaped baffles 824B at the inlet portion 818. In contrast to the faucet spouts described above, the internal passageway 822 includes a double, or "top-to-top", L-shaped baffle 824C at the center of the internal passageway 822 instead of the upstream-most circular baffle 124A (shown elsewhere).

Figure 9:
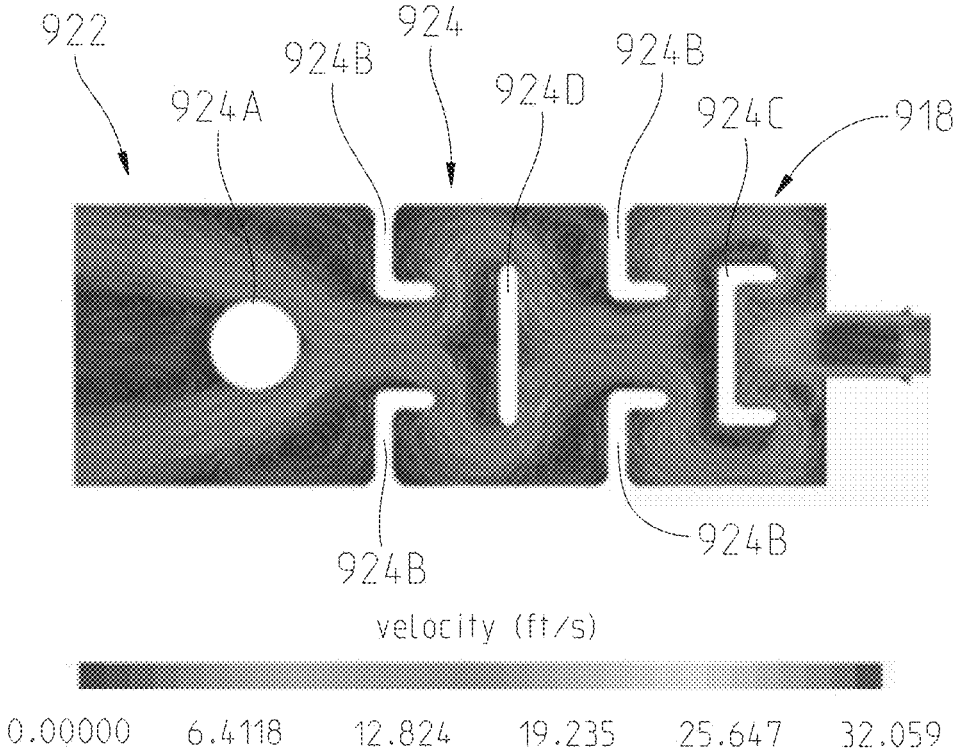
FIG. 9 is a velocity profile illustrating velocities of water at different locations in an inlet portion of an internal passageway of another illustrative faucet spout.

FIG. 9 shows another illustrative embodiment of a plurality of baffles 924 for an inlet portion 918 of an internal passageway 922 of a faucet spout, in addition to the associated velocity profile in the internal passageway 922. The inlet portion 918 may be used with any of the outlet portions of internal passageways described herein. Many of the elements illustrated in FIG. 9 are the same as the elements of the faucet spout 100 described above. As such, in the following description, like elements are identified with similar reference numbers. Generally, the internal passageway 922 includes a circular baffle 924A and L-shaped baffles 924B at the inlet portion 918. In contrast to other faucet spouts described above, the internal passageway 922 includes a double, or "top-to-top" L-shaped baffle 924C at the center of the internal passageway 922 instead of the upstream-most circular baffle 124A (shown elsewhere). In addition, the internal passageway 922 include a flat, or I-shaped, baffle 924D at the center of the internal passageway 922 instead of the second upstream-most circular baffle 124A (shown elsewhere).

Figure 10:
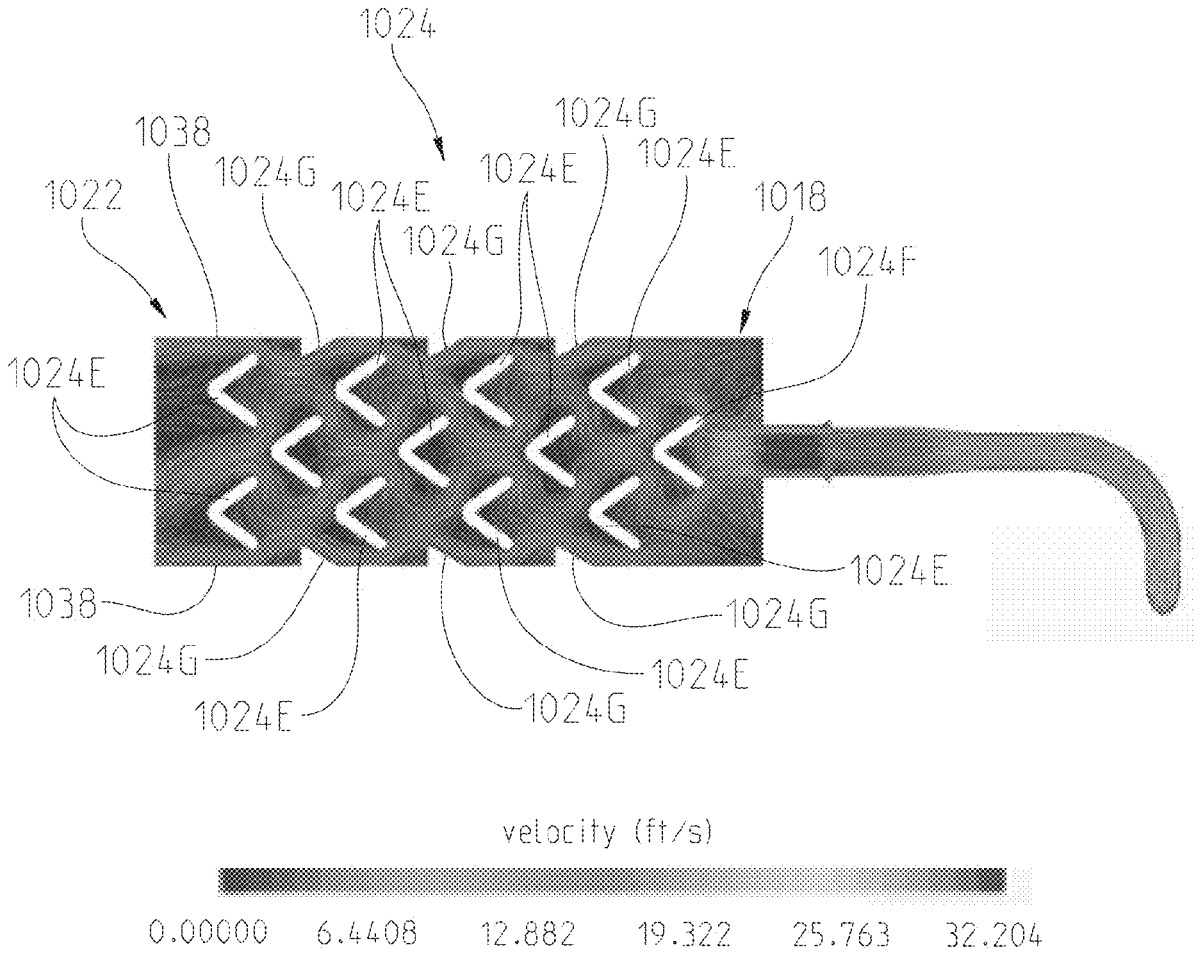
FIG. 10 is a velocity profile illustrating velocities of water at different locations in an inlet portion of an internal passageway of another illustrative faucet spout.
Figure 11D:
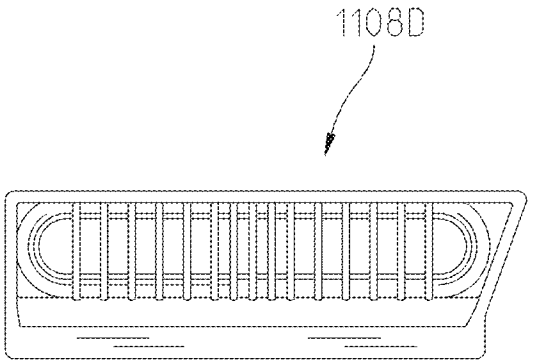
FIGS. 11A-11E are side views of illustrative side outlets.
Figure 11E:
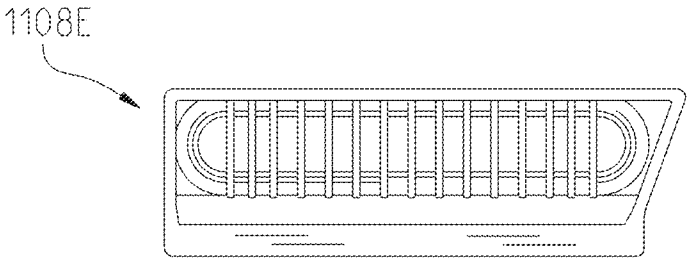
Figure 11A:
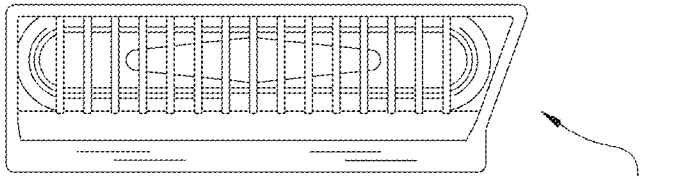
Figure 11B:
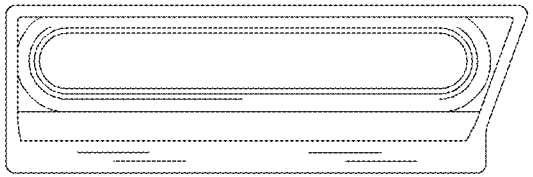
Figure 11C:
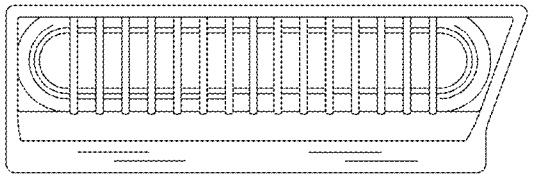

FIG. 10 shows another illustrative embodiment of a plurality of baffles 1024 for an inlet portion 1018 of an internal passageway 1022 of a faucet spout, in addition to the associated velocity profile in the internal passageway 1022. The inlet portion 1018 may be used with any of the outlet portions of internal passageways described herein. Generally, the internal passageway 1022 includes a plurality of chevron-shaped baffles 1024E and 1024F disposed apart from the sidewalls 1038 and generally pointing in a downstream direction. One or more of the chevron-shaped baffles 1024E may have a first size, and one or more of the chevron-shaped baffles 1024F may have a second size that is larger than the first size. More specifically and as illustrated, the upstream-most chevron-shaped baffle 1024F may be larger than the remainder of the chevron-shaped baffles 1024E. The internal passageway 1022 also includes a plurality of triangular baffles 1024G extending from the sidewalls 1038.

FIGS. 11A-11E are side views of illustrative side outlets 1108A, 1108B, 1108C, 1108D, and 1108E, respectively, each of which may be used with any of the faucet spouts described herein.

Figure 12:
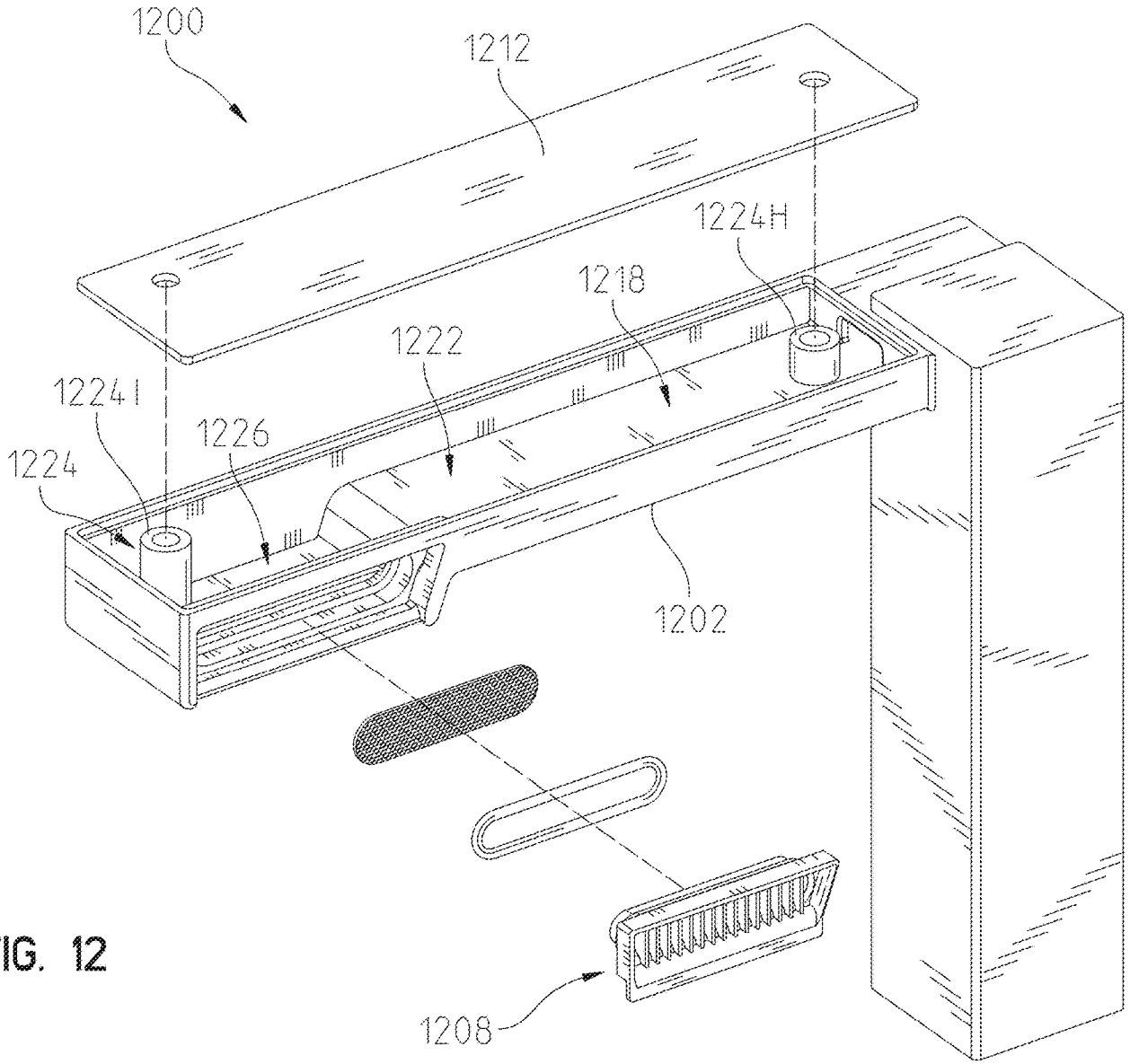
FIG. 12 is an exploded top perspective view of another illustrative faucet spout including a side outlet.

FIG. 12 shows another illustrative faucet spout 1200. Many of the elements illustrated in FIG. 12 are the same as the elements of the faucet spout 100 described above. As such, in the following description, like elements are identified with similar reference numbers. The faucet spout 1200 generally includes an arm 1202, a top cover 1212 (both of which may comprise, for example, a cast metal), and a side outlet 1208. The arm 1202 and the top cover 1212 may be sealingly coupled, for example, via brazing, an elastomer, directly casting the top cover 1212 on the arm 1202, or the like. The arm 1202 and the top cover 1212 together define an internal passageway 1222 that delivers water to the side outlet 1208. That is, the faucet spout 1200 lacks an internal passageway cover (such as the internal passageway cover 114—shown elsewhere) and an internal passageway base (such as the internal passageway base 120—shown elsewhere). The internal passageway 1222 includes a plurality of baffles 1224 that reduces the velocity of water through the passageway 1222 and facilitates directing flow in view of the presence of the side outlet 1208. Illustratively, the baffles 1224 include a first baffle 1224H disposed at an inlet portion 1218 of the passageway 1222 and a second baffle 1224I disposed at an outlet portion 1226 of the passageway 1222. Illustratively, the first baffle 1224H and the second baffle 1224I have circular cross sections. Alternatively, the baffles 1224 may have the shapes, sizes, and/or arrangements of any of the baffles described herein.

Figure 13A:
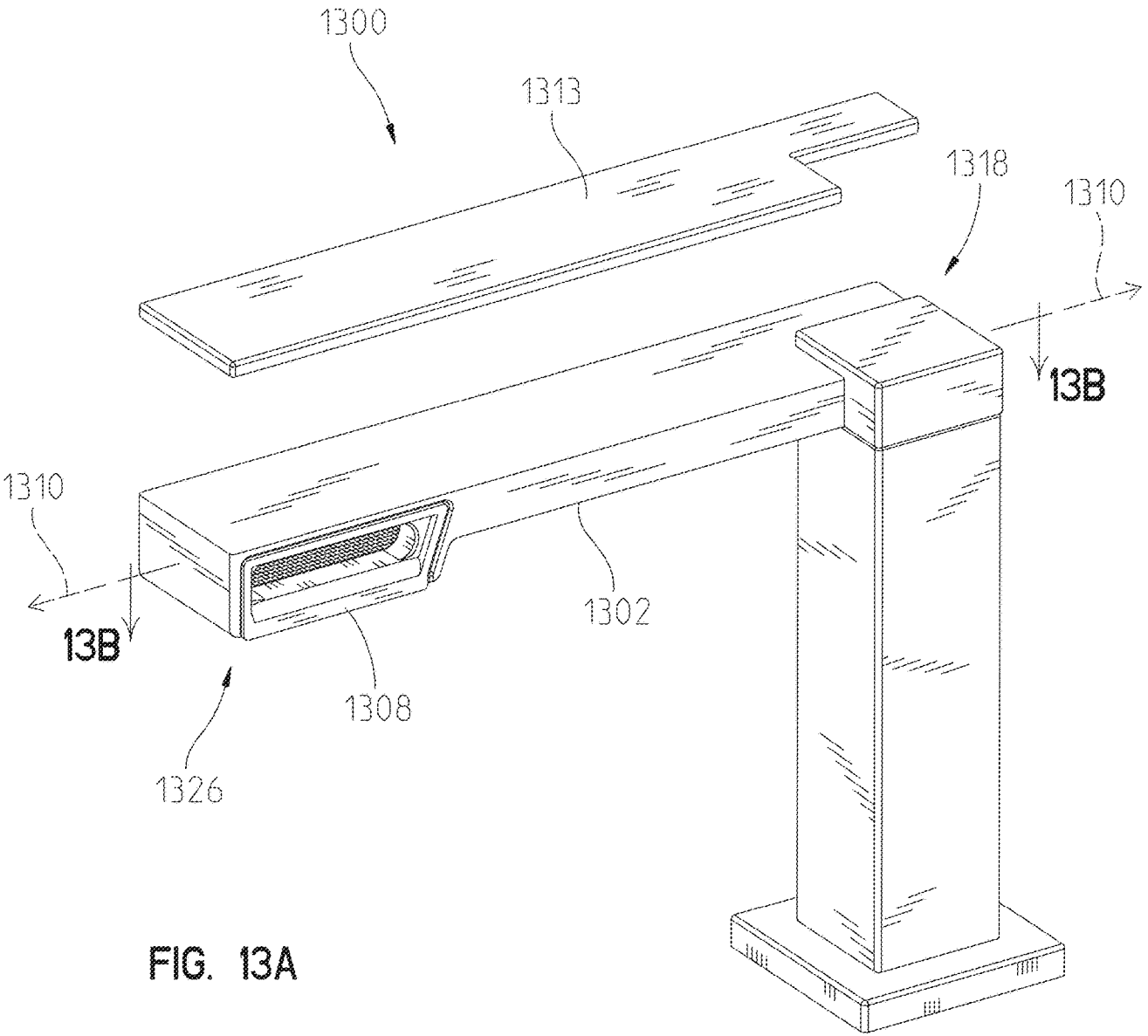
FIG. 13A is a partially exploded top perspective view of yet another illustrative faucet spout including a side outlet.
Figure 13B:
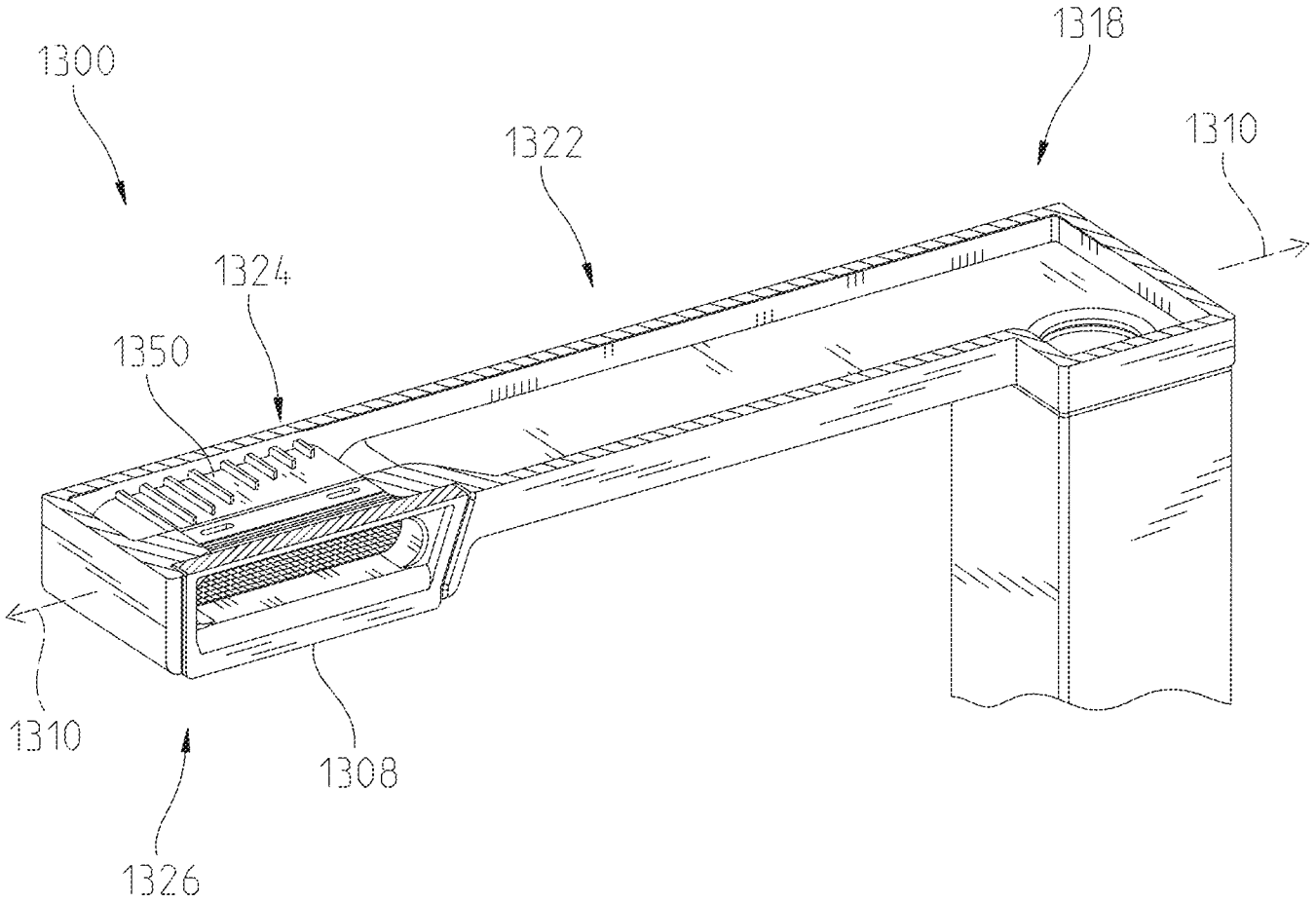
FIG. 13B is a perspective sectional view of the faucet spout along line 13B-13B of FIG. 13A.

FIGS. 13A and 13B show another illustrative faucet spout 1300. Many of the elements illustrated in FIGS. 13A and 13B are the same as the elements of the faucet spout 100 described above. As such, in the following description, like elements are identified with similar reference numbers. The faucet spout 1300 generally includes an arm 1302 (which may comprise, for example, metal or plastic), a top cover 1313 (which may comprise, for example, metal, plastic, or wood), and a side outlet 1308. The arm 1302 and the top cover 1313 may be coupled, for example, via an adhesive, brazing, an elastomer, directly casting the top cover 1313 on the arm 1302, or the like. With specific reference to FIG. 13B, the arm 1302 defines an internal passageway 1322 through which water flows from an inlet portion 1318 of the faucet spout 1300 to an outlet portion 1326. More specifically, the internal passageway 1322 delivers water to the side outlet 1308. The internal passageway 1322 carries a flow director 1350, illustratively, at the outlet portion 1326 of the faucet spout 1300. The flow director 1350 enhances flow of water through the faucet spout 1300 in several manners. More specifically, the flow director 1350 reduces the velocity of water through the passageway 1322, straightens the flow of water, and normalizes the velocity of water across the face of the side outlet 1308. To provide these enhancements, the flow director 1350 includes, generally, one or more upper baffles 1324, one or more lower baffles (shown elsewhere), and one or more internal channels (shown elsewhere). Generally, the baffles restrict flow in some areas of the internal passageway 1322 and promote flow in other areas of the internal passageway 1322. Stated another way, the baffles redirect flow in a staggered manner rearwardly around the opening of the outlet assembly 1352 thereby straightening flow and removing turbulence. These features, among others, are described in further detail below.

In contrast to the top cover 1212 of the faucet spout 1200 described above and shown elsewhere, in some embodiments the top cover 1313 of the faucet spout 1300 may only be provided for aesthetic purposes. That is, the top cover 1313 may not define, together with other components, the internal passageway 1322 of the faucet spout 1300. As a result, the internal passageway 1322 may be formed simply by casting the arm 1302 of the faucet spout 1300. Alternatively, the top cover 1313 may be omitted, or the top cover 1313 may define, together with the arm 1302, the internal passageway 1322.

FIGS. 14A-14F illustrate an outlet assembly 1352 of the faucet spout 1300, which includes the side outlet 1308 and the flow director 1350. The side outlet 1308 includes a permeable screen 1328, which may reduce velocity variations across the outlet 1308 and inhibit dripping from the outlet 1308 by providing surface tension. The side outlet 1308 further includes an outlet cover 1332, and the outlet cover 1332 may provide a drip edge and inhibit corrosion of any metal components of the faucet spout 1300. The outlet cover 1332 and the flow director 1350 include one or more coupling features (illustratively, apertures 1354 and snap protrusions 1356) for coupling the components to each other, and the outlet cover 1332 and the flow director 1350 carry the screen 1328 therebetween.

Figure 14A:
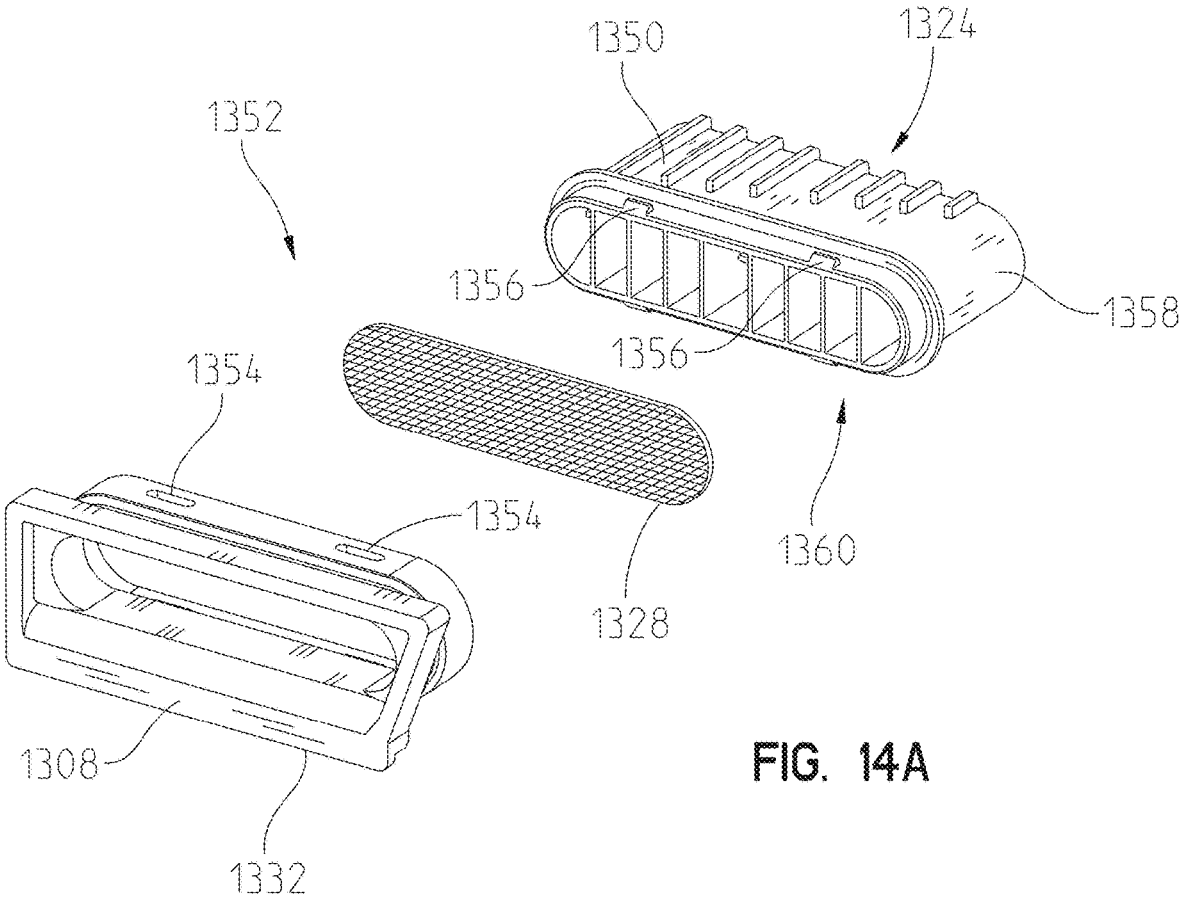
FIG. 14A is an exploded top perspective view of an outlet assembly of the faucet spout of FIG. 13A.
Figure 14B:
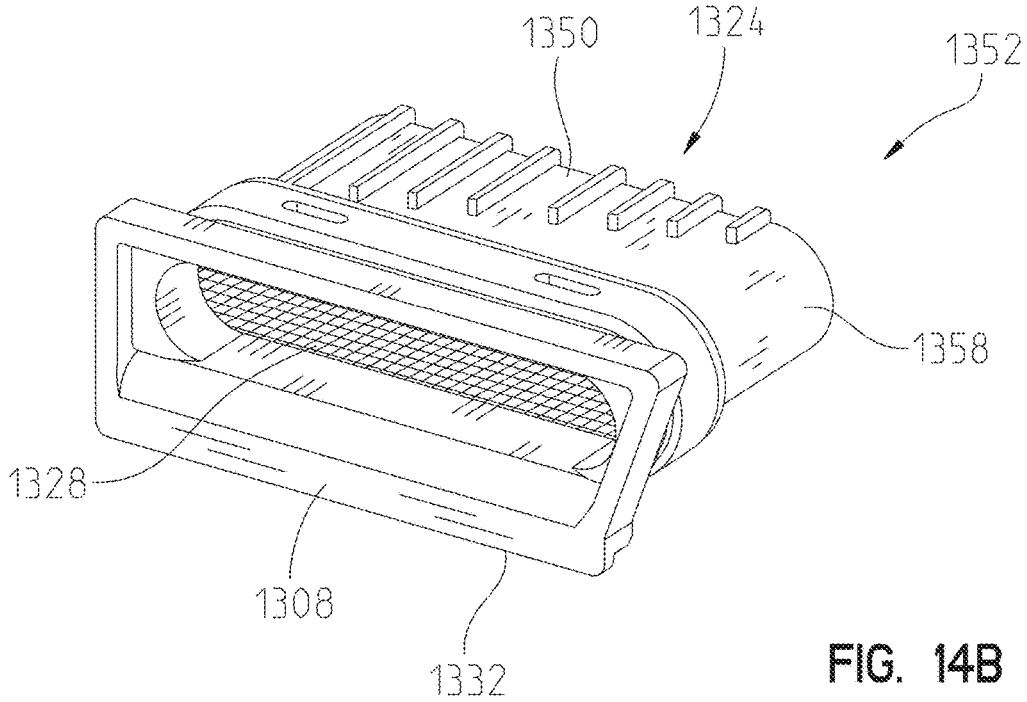
FIG. 14B is a top, first side perspective view of the outlet assembly of FIG. 14A.
Figure 14C:
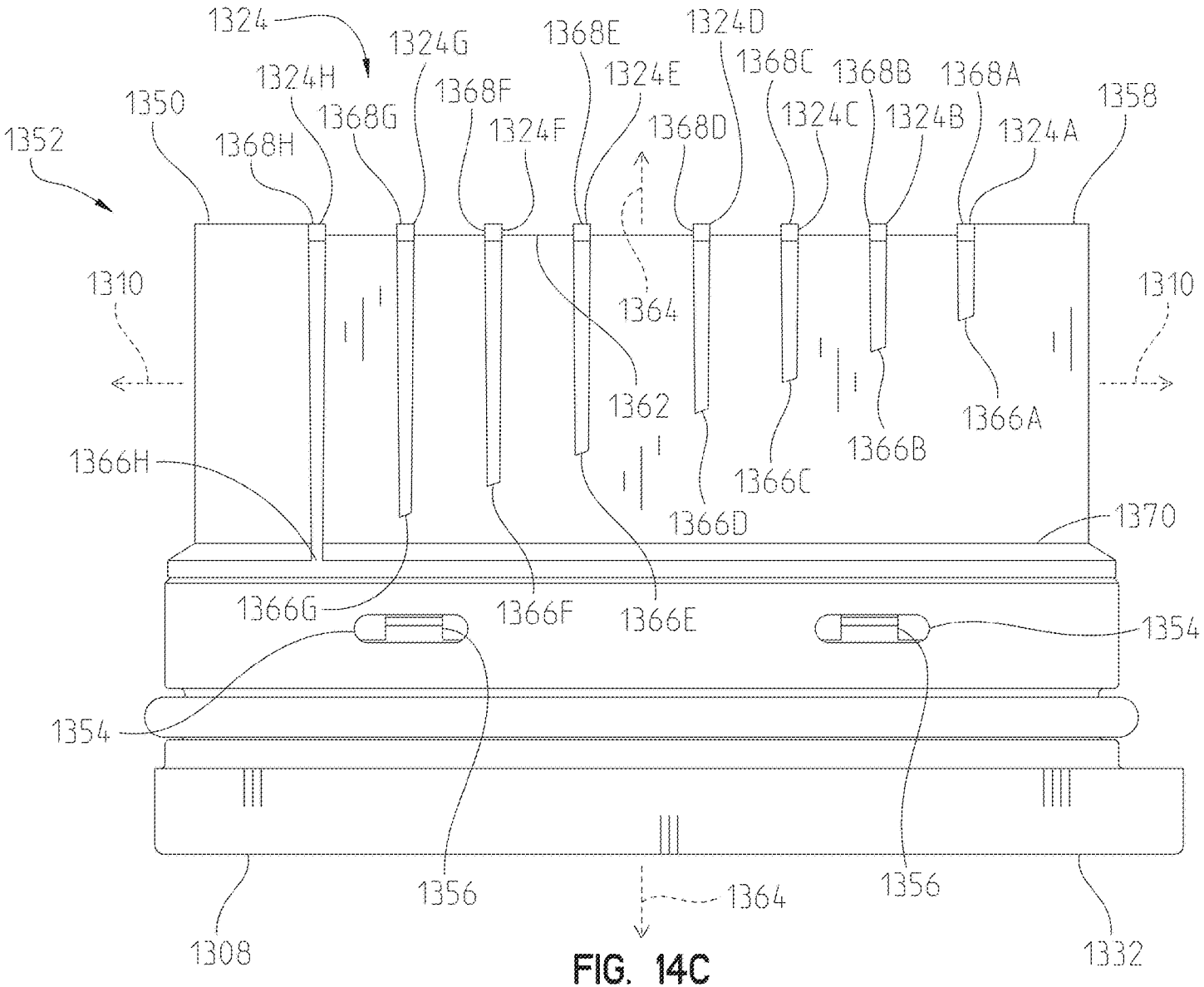
FIG. 14C is a first side view of the outlet assembly of FIG. 14A.
Figure 14D:
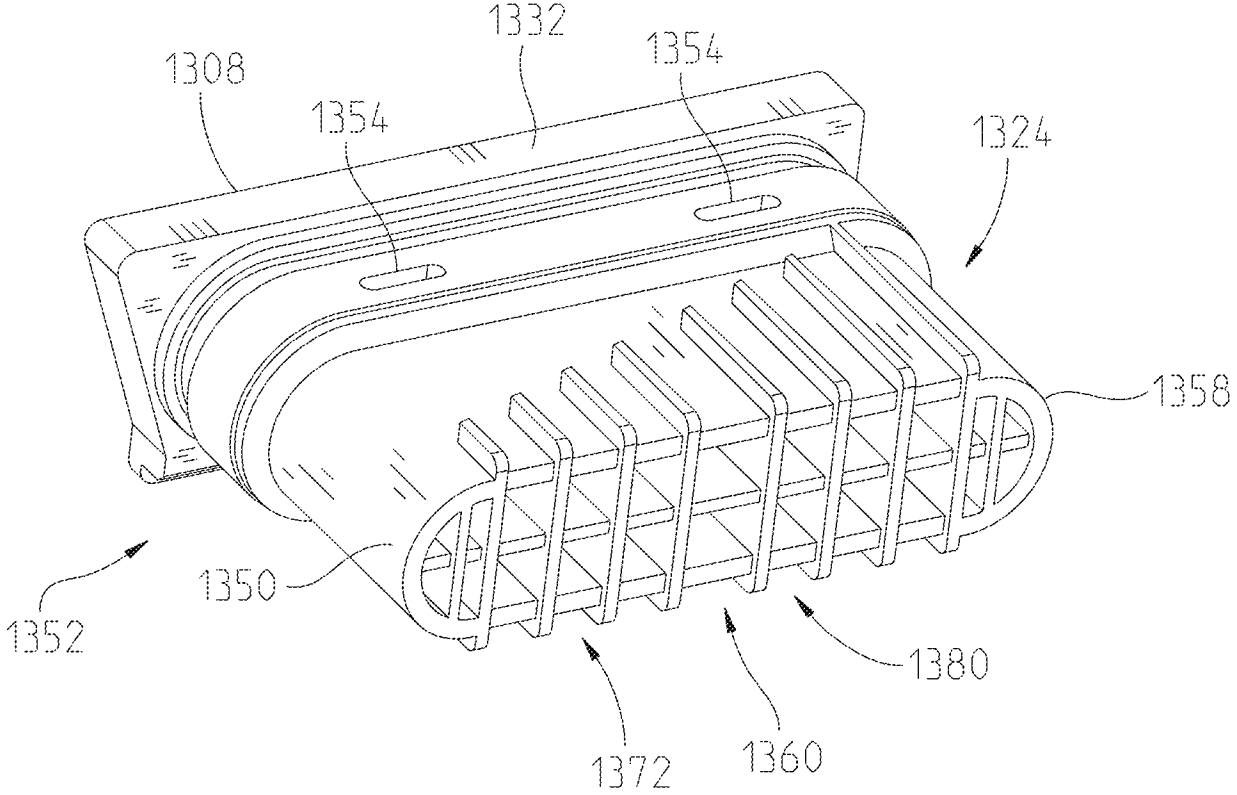
FIG. 14D is a top, second side perspective view of the outlet assembly of FIG. 14A.

With continued reference to FIGS. 14A-14F, the flow director 1350 is a monolithic component that comprises one or more appropriate materials (for example, metal or plastic). The flow director 1350 generally includes a body 1358 that defines an internal passageway 1360, and the internal passageway 1360 is divided into the internal channels. In FIG. 14C, the flow director 1350 is illustratively shown at scale of about 1:0.25 (that is, 1 unit of measurement in FIG. 14C corresponds to about 0.25 units of measurement for the physical component). Alternatively, one or more features, or the entire flow director 1350, may have different dimensions.

With specific reference to FIG. 14C, the upper baffles 1324 of the flow director 1350 are illustrated. The upper baffles 1324 are carried on an upper external surface 1362 of the flow director 1350. Illustratively, the flow director 1350 includes a first upper baffle 1324A, a second upper baffle 1324B, a third upper baffle 1324C, a fourth upper baffle 1324D, a fifth upper baffle 1324E, a sixth upper baffle 1324F, a seventh upper baffle 1324G, and an eighth upper baffle 1324H. Illustratively, the upper baffles 1324 are elongated in a transverse direction 1364 that is substantially perpendicular to the longitudinal axis 1310, and one or more of the upper baffles 1324 may have different lengths in the transverse direction 1364. More specifically and as illustrated, the upper baffles 1324 may have increasing lengths in the transverse direction 1364 proceeding away from the inlet portion 1318 of the faucet spout 1300 (shown elsewhere). More specifically, the first upper baffle 1324A has a first length in the transverse direction 1364, the second upper baffle 1324B has a second length in the transverse direction 1364 that is greater than the first length, the third upper baffle 1324C has a third length in the transverse direction 1364 that is greater than the second length, the fourth upper baffle 1324D has a fourth length in the transverse direction 1364 that is greater than the third length, the fifth upper baffle 1324E has a fifth length in the transverse direction 1364 that is greater than the fourth length, the sixth upper baffle 1324F has a sixth length in the transverse direction 1364 that is greater than the fifth length, the seventh upper baffle 1324G has a seventh length in the transverse direction 1364 that is greater than the sixth length, and the eighth upper baffle 1324H has an eighth length in the transverse direction 1364 that is greater than the seventh length. Stated another way, the first upper baffle 1324A has a first upstream end 1366A and a first downstream end 1368A, the second upper baffle 1324B has a second upstream end 1366B and a second downstream end 1368B, the second upstream end 1366B being offset from the first upstream end 1366A in the transverse direction 1364 and toward the side outlet 1308, the third upper baffle 1324C has a third upstream end 1366C and a third downstream end 1368C, the third upstream end 1366C being offset from the second upstream end 1366B in the transverse direction 1364 and toward the side outlet 1308, the fourth upper baffle 1324D has a fourth upstream end 1366D and a fourth downstream end 1368D, the fourth upstream end 1366D being offset from the third upstream end 1366C in the transverse direction 1364 and toward the side outlet 1308, the fifth upper baffle 1324E has a fifth upstream end 1366E and a fifth downstream end 1368E, the fifth upstream end 1366E being offset from the fourth upstream end 1366D in the transverse direction 1364 and toward the side outlet 1308, the sixth upper baffle 1324F has a sixth upstream end 1366F and a sixth downstream end 1368F, the sixth upstream end 1366F being offset from the fifth upstream end 1366E in the transverse direction 1364 and toward the side outlet 1308, the seventh upper baffle 1324G has a seventh upstream end 1366G and a seventh downstream end 1368G, and the seventh upstream end 1366G being offset from the sixth upstream end 1366F in the transverse direction 1364 and toward the side outlet 1308. The eighth upper baffle 1324H includes an eighth upstream end 1366H and an eighth downstream end 1368H, and the eighth upstream end 1366H is monolithically coupled to an upstream wall 1370 of the flow director 1350. Illustratively, the lengths of the upper baffles 1324 differ, or the upstream ends 1366A-1366G of the upper baffles 1324 are offset, according to a linear function. These features may be offset according to a linear function provided that the incoming flow is generally perpendicular to the baffles 1324. Illustratively, the upstream ends 1366A-1366G of the upper baffles 1324 may be disposed at an acute angle, or extend diagonally, relative to the longitudinal axis 1310.

Figure 14E:
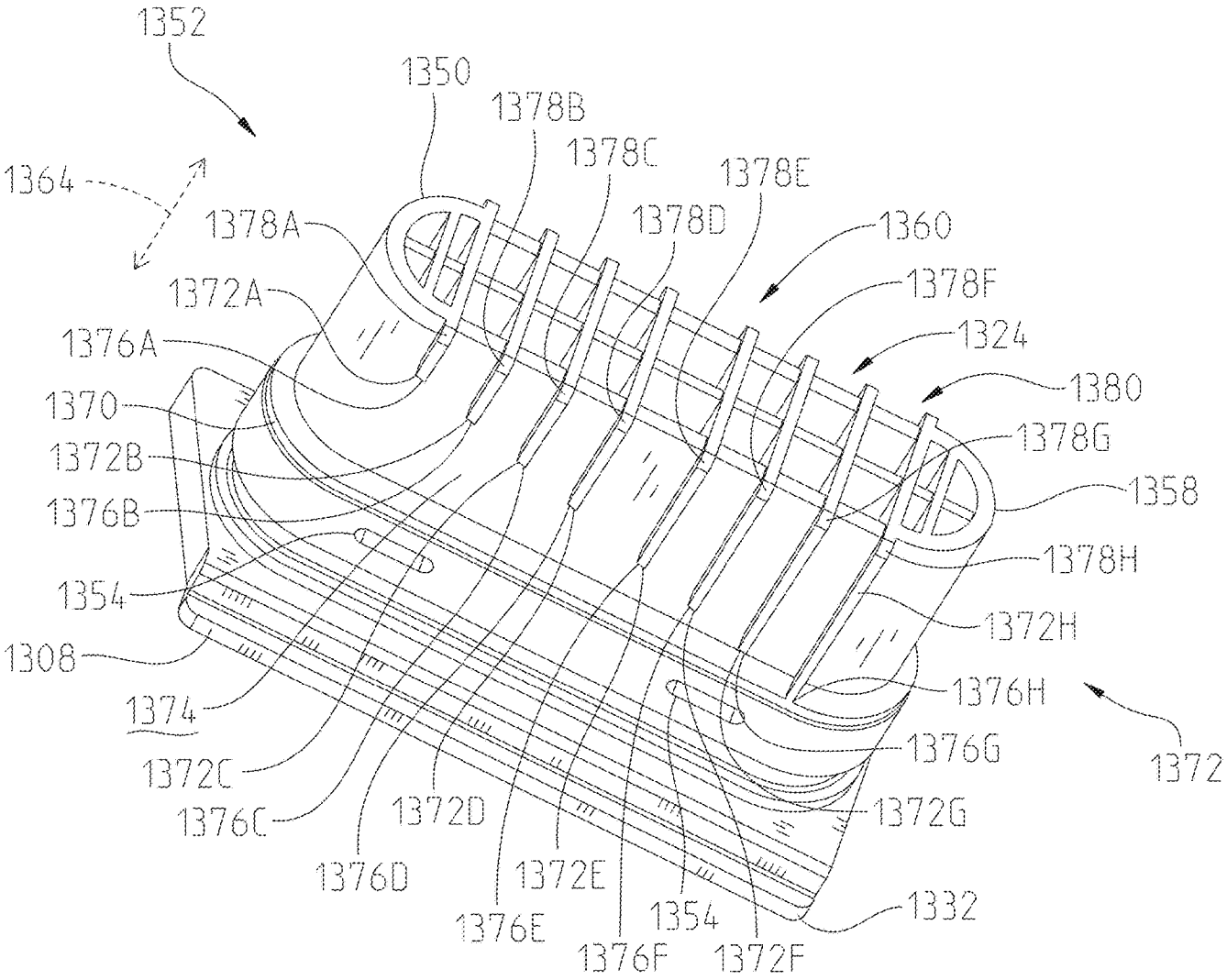
FIG. 14E is a bottom, second side perspective view of the outlet assembly of FIG. 14A.

With specific reference to FIG. 14E, lower baffles 1372 of the flow director 1350 are illustrated. The lower baffles 1372 are carried on a lower external surface 1374 of the flow director 1350. Illustratively, the flow director 1350 includes a first lower baffle 1372A, a second lower baffle 1372B, a third lower baffle 1372C, a fourth lower baffle 1372D, a fifth lower baffle 1372E, a sixth lower baffle 1372F, a seventh lower baffle 1372G, and an eighth lower baffle 1372H. Illustratively, the lower baffles 1372 are elongated in the transverse direction 1364, and one or more of the lower baffles 1372 may have different lengths in the transverse direction 1364. More specifically and as illustrated, the lower baffles 1372 may have increasing lengths in the transverse direction 1364 proceeding away from the inlet portion 1318 of the faucet spout 1300 (shown elsewhere). More specifically, the first lower baffle 1372A has a first length in the transverse direction 1364, the second lower baffle 1372B has a second length in the transverse direction 1364 that is greater than the first length, the third lower baffle 1372C has a third length in the transverse direction 1364 that is greater than the second length, the fourth lower baffle 1372D has a fourth length in the transverse direction 1364 that is greater than the third length, the fifth lower baffle 1372E has a fifth length in the transverse direction 1364 that is greater than the fourth length, the sixth lower baffle 1372F has a sixth length in the transverse direction 1364 that is greater than the fifth length, the seventh lower baffle 1372G has a seventh length in the transverse direction 1364 that is greater than the sixth length, and the eighth lower baffle 1372H has an eighth length in the transverse direction 1364 that is greater than the seventh length. Stated another way, the first lower baffle 1372A has a first upstream end 1376A and a first downstream end 1378A, the second lower baffle 1372B has a second upstream end 1376B and a second downstream end 1378B, the second upstream end 1376B being offset from the first upstream end 1376A in the transverse direction 1364 and toward the side outlet 1308, the third lower baffle 1372C has a third upstream end 1376C and a third downstream end 1378C, the third upstream end 1376C being offset from the second upstream end 1376B in the transverse direction 1364 and toward the side outlet 1308, the fourth lower baffle 1372D has a fourth upstream end 1376D and a fourth downstream end 1378D, the fourth upstream end 1376D being offset from the third upstream end 1376C in the transverse direction 1364 and toward the side outlet 1308, the fifth lower baffle 1372E has a fifth upstream end 1376E and a fifth downstream end 1378E, the fifth upstream end 1376E being offset from the fourth upstream end 1376D in the transverse direction 1364 and toward the side outlet 1308, the sixth lower baffle 1372F has a sixth upstream end 1376F and a sixth downstream end 1378F, the sixth upstream end 1376F being offset from the fifth upstream end 1376E in the transverse direction 1364 and toward the side outlet 1308, the seventh lower baffle 1372G has a seventh upstream end 1376G and a seventh downstream end 1378G, and the seventh upstream end 1376G being offset from the sixth upstream end 1376F in the transverse direction 1364 and toward the side outlet 1308. The eighth lower baffle 1372H includes an eighth upstream end 1376H and an eighth downstream end 1378H, and the eighth upstream end 1376H is monolithically coupled to the upstream wall 1370 of the flow director 1350. Illustratively, the lengths of the lower baffles 1372 differ, or the upstream ends 1376 of the lower baffles 1372 are offset, according to a linear function. These features may be offset according to a linear function provided that the incoming flow is generally perpendicular to the baffles 1372. Illustratively, the upstream ends 1376 of the lower baffles 1372 may be disposed at an acute angle, or extend diagonally, relative to the longitudinal axis 1310.

Figure 14F:
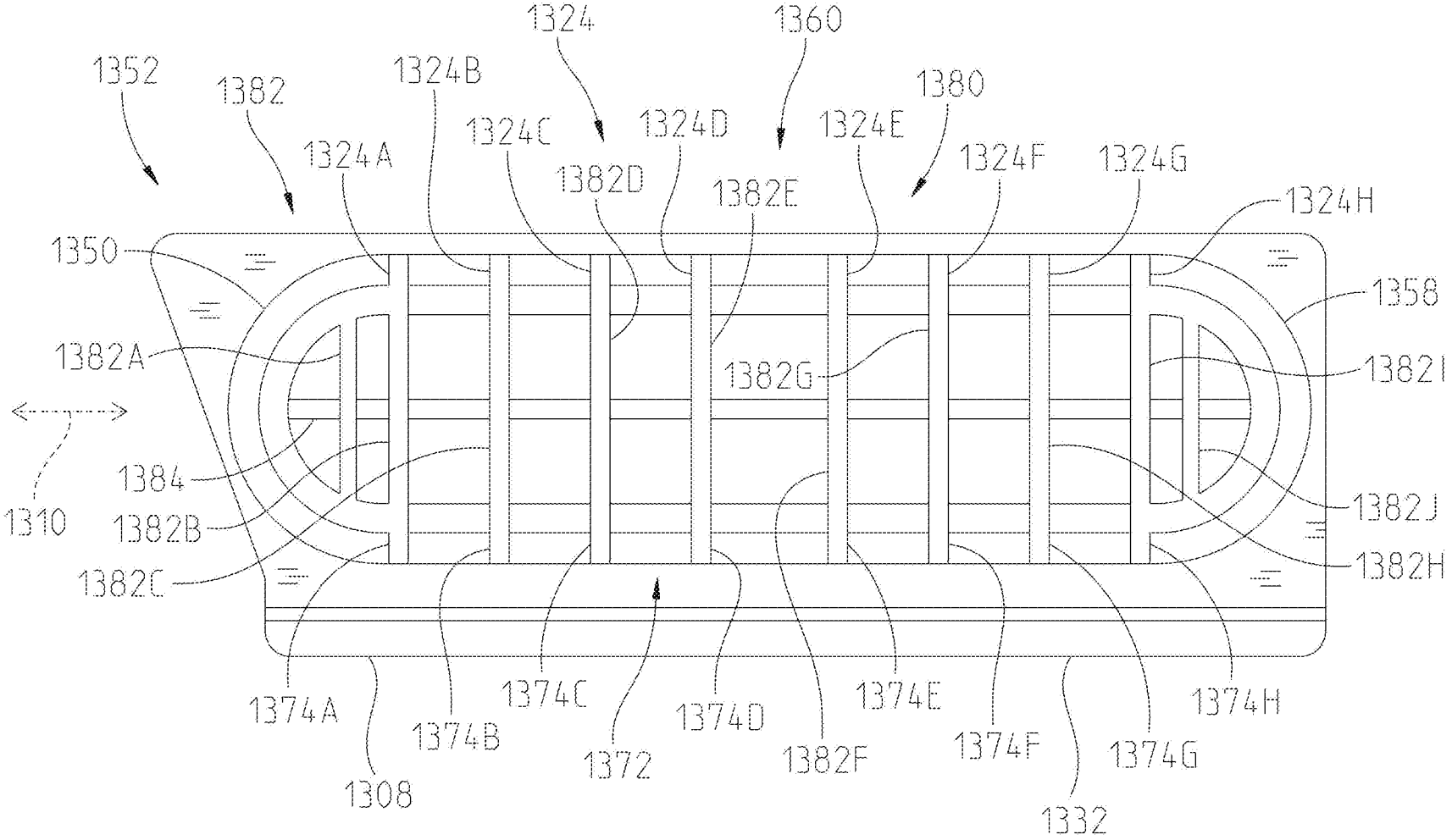
FIG. 14F is a second side view of the outlet assembly of FIG. 14A.

With specific reference to FIG. 14F, internal channels 1380, which are separated by dividers, of the flow director 1350 are also illustrated. Illustratively, the dividers include one or more "vertical" dividers 1382 and one or more "horizontal" dividers 1384 that define various "columns" and "rows" of internal channels 1380, respectively. Two or more of the vertical dividers 1382 may be disposed in substantially parallel planes (e.g., vertical planes). One or more of the vertical dividers 1382 may be disposed in planes substantially perpendicular to planes of one or more of the horizontal dividers 1384 (e.g., one or more vertical dividers 1382 may be disposed in vertical planes and one or more horizontal dividers 1384 may be disposed in horizontal planes).

Illustratively, the dividers include ten vertical dividers 1382 and one horizontal divider 1384. The vertical dividers 1382 include a first side divider 1382A and a second side divider 1382J that are disposed on opposite sides of the upper baffles 1324 and the lower baffles 1372. The vertical dividers 1382 further include eight intermediate baffles, more specifically a first intermediate divider 1382B, a second intermediate divider 1382C, a third intermediate divider 1382D, a fourth intermediate divider 1382E, a fifth intermediate divider 1382F, a sixth intermediate divider 1382G, a seventh intermediate divider 1382H, and an eighth intermediate divider 1382I. The first intermediate divider 1382B may be substantially aligned with the first upper baffle 1324A and/or the first lower baffle 1372A relative to the longitudinal axis 1310 (as used herein, "substantially aligned" and variations thereof being understood to mean aligned ±0.1 inches or 2.54 mm). The second intermediate divider 1382C may be substantially aligned with the second upper baffle 1324B and/or the second lower baffle 1372B relative to the longitudinal axis 1310. The third intermediate divider 1382D may be substantially aligned with the third upper baffle 1324C and/or the third lower baffle 1372C relative to the longitudinal axis 1310. The fourth intermediate divider 1382E may be substantially aligned with the fourth upper baffle 1324D and/or the fourth lower baffle 1372AD relative to the longitudinal axis 1310. The fifth intermediate divider 1382F may be substantially aligned with the fifth upper baffle 1324E and/or the fifth lower baffle 1372E relative to the longitudinal axis 1310. The sixth intermediate divider 1382G may be substantially aligned with the sixth upper baffle 1324F and/or the sixth lower baffle 1372F relative to the longitudinal axis 1310. The seventh intermediate divider 1382H may be substantially aligned with the seventh upper baffle 1324G and/or the seventh lower baffle 1372G relative to the longitudinal axis 1310. The eighth intermediate divider 1382I may be substantially aligned with the eighth upper baffle 1324H and/or the eighth lower baffle 1372H relative to the longitudinal axis 1310.

Alternatively, the flow director 1350 may have different structures that those described above. For example, the flow director 1350 may be formed from separate components, such as a body 1358 that couples to flat plates (not shown) that provide the baffles 1324 and 1372 and/or the dividers 1382. As another example, the flow director 1350 may lack the upper baffles 1324 or the lower baffles 1372, or the flow director 1350 may include different numbers of upper baffles 1324 and/or lower baffles 1372, or the baffles 1324 may have the shapes, sizes, and/or arrangements of any of the other baffles described herein. As another example, the baffles 1324 and/or lower baffles 1372 may have lengths that differ according to a different type of mathematical function (particularly if the incoming flow is not generally perpendicular to the baffles 1324 and/or 1372), or the baffles 1324 and/or lower baffles 1372 may have different lengths, but the lengths do not vary according to a mathematical function. As yet another example, the flow director 1350 may include different numbers, shapes, sizes, and/or arrangements of dividers 1382 or 1384. Similarly, various features may be modified, such as the number of baffles 1324 and/or 1372, the linear function of the baffles 1324 and/or 1372, and/or the spacing between the flow director 1350 and the wall of the internal passageway 1322 to improve flow at the side outlet 1308, for example, in view of modifications to the dimensions of the faucet spout 1300 and/or different characteristics of incoming flow. As a specific example and referring to FIG. 14C, if the incoming flow provides relatively high velocity near the first upper baffle 1324A and the eighth upper baffle 1324H, or near the third upper baffle 1324C and the seventh upper baffle 1324G, the baffles 1324 may be arranged according to a "step function." That is, two or more groups of baffles 1324 may include multiple baffles 1324 having the same length. For example, the first upper baffle 1324A, the second upper baffle 1324B, the third upper baffle 1324C, and the fourth upper baffle 1324D may have a first length, and the fifth upper baffle 1324E, the sixth upper baffle 1324F, the seventh upper baffle 1324G, and the eighth upper baffle 1324H may have a second length greater than the first length. The lower baffles 1372 may alternatively or additionally be arranged in a similar manner. As yet another example, the faucet spout 1300 may additionally include features of any of the illustrative side outlets 1108A, 1108B, 1108C, 1108D, and 1108E shown in FIGS. 11A-11E.

Figure 15A:
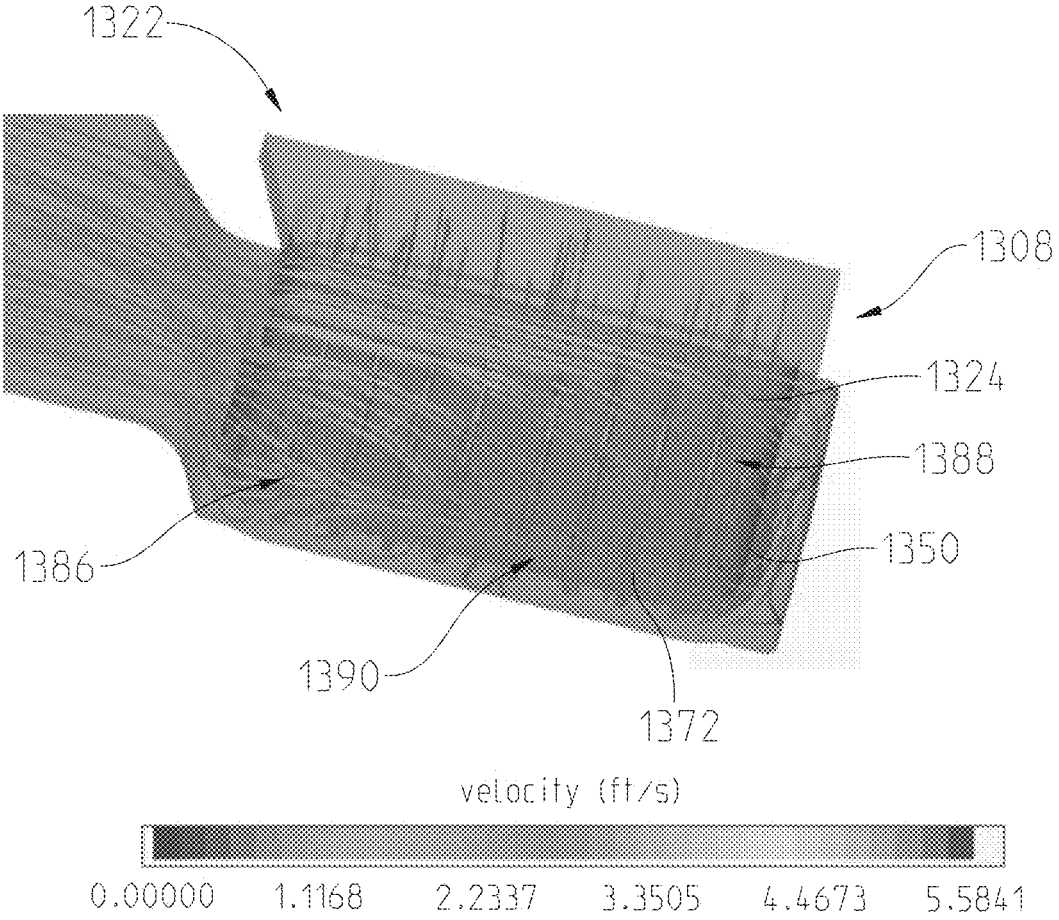
FIG. 15A is a velocity profile illustrating relative velocities of water at different locations in the internal passageway of the faucet spout of FIG. 13A.
Figure 15B:
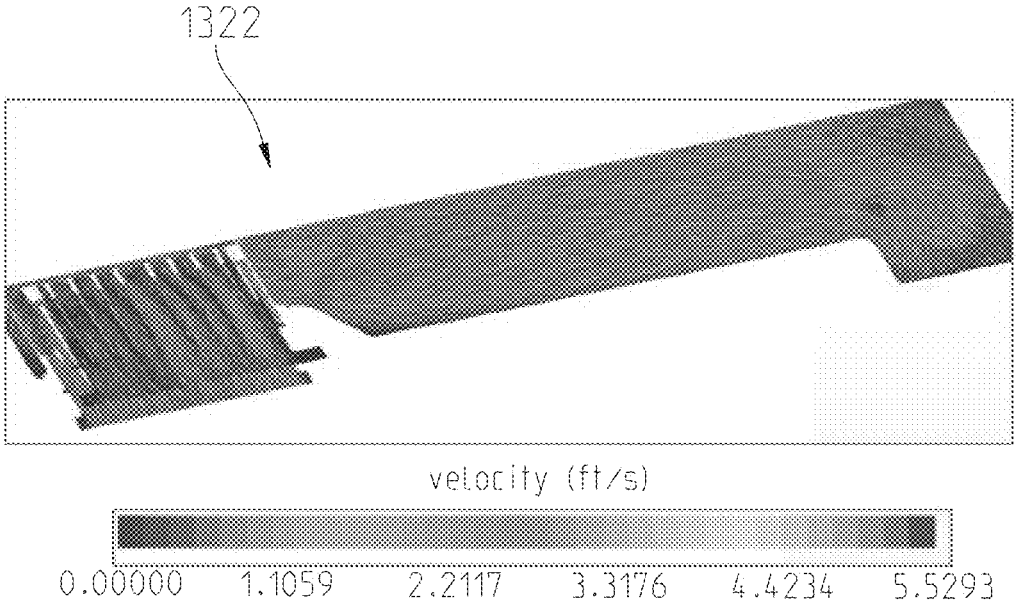
FIG. 15B is another velocity profile illustrating relative velocities of water at different locations in the internal passageway of the faucet spout of FIG. 13A.
Figure 15C:
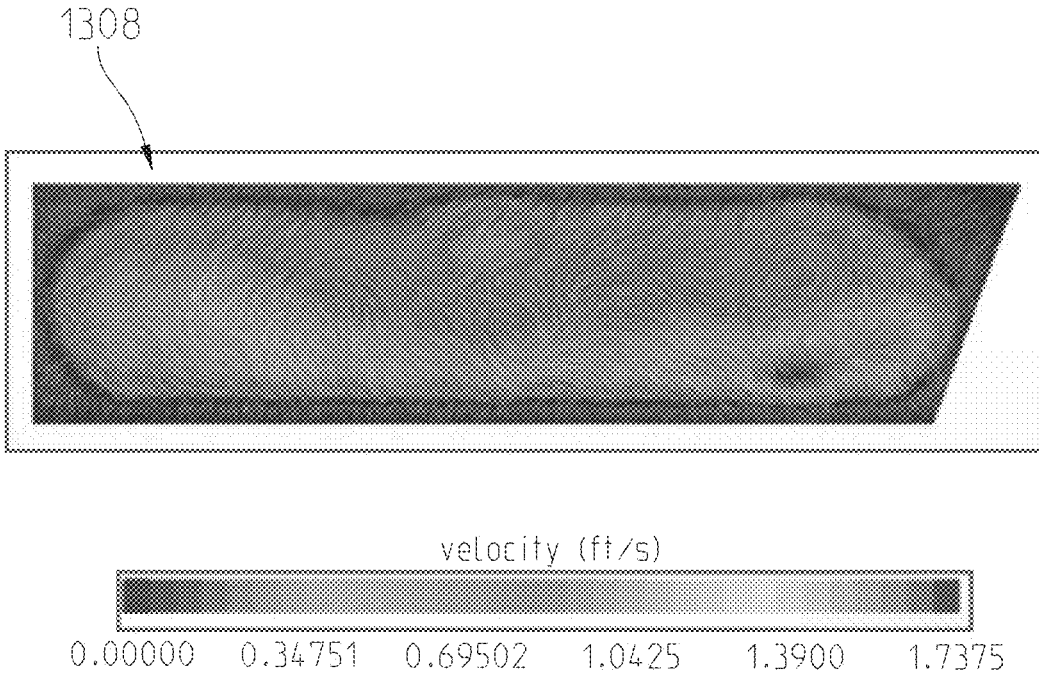
FIG. 15C is a velocity profile illustrating relative velocities of water at different locations across the face of an outlet of the faucet spout of FIG. 13A.
Figure 15D:
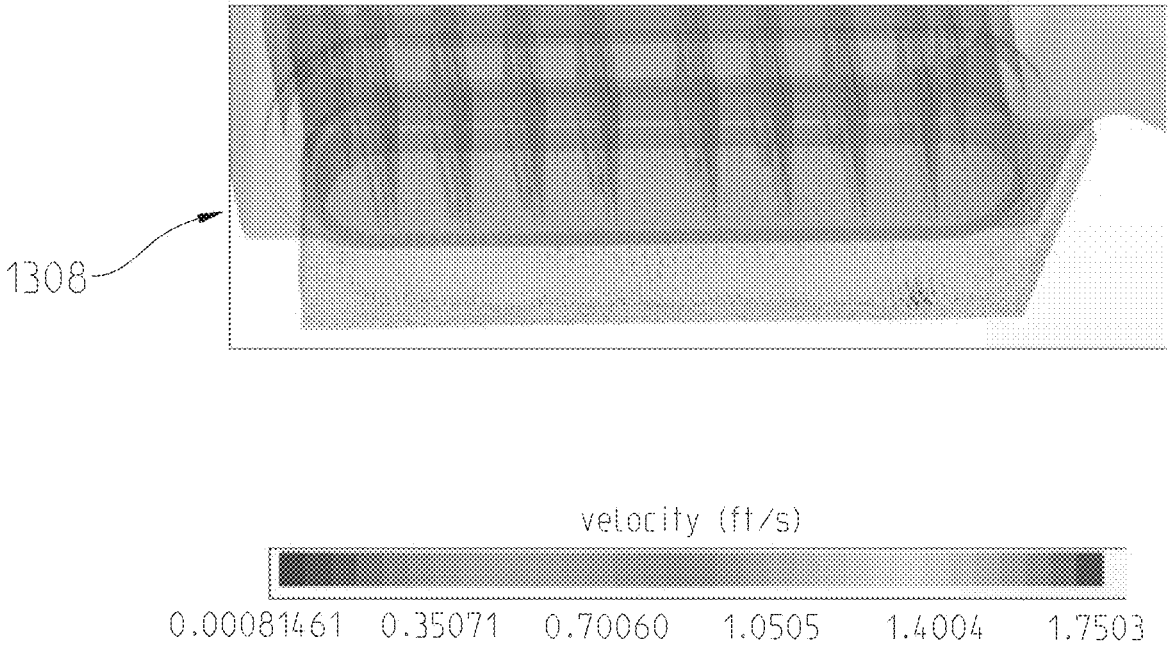
FIG. 15D is another velocity profile illustrating relative velocities of water at different locations across the face of the outlet of the faucet spout of FIG. 13A.

FIGS. 15A and 15B are velocity profiles illustrating relative velocities of water at different locations in the internal passageway 1322, and FIGS. 15C and 15D are velocity profiles illustrating relative velocities of water across the face of the outlet 1308, respectively. As illustrated, water enters the internal passageway 1322 at a relatively high velocity (for example, about 3 feet per second), and the flow director 1350 reduces the velocity such that water is delivered from the outlet 1308 at a relatively low and uniform velocity (for example, an average velocity of about 0.65 feet per second with a standard deviation of about 0.43 feet per second). In addition, FIG. 15A illustrates how the features of the faucet spout 1300, including the baffles 1324 and 1372 and the dividers 1382, for example, facilitate flow in some areas and inhibit flow in other areas to improve flow characteristics at the outlet 1308. Stated another way, FIG. 15A illustrates how the flow director 1350 defines a tortuous flow path 1386 for water in the passageway 1322. The tortuous flow path 1386 includes a first, external segment 1388 disposed above and below the upper baffles 1324 and the lower baffles 1372, respectively, in which water flows away from the outlet 1308. The tortuous flow path 1386 also includes a second, internal segment 1390 in which water is received from the first segment 1388 and water flows through the internal channels 1380 toward the outlet 1308.

Various modifications and additions can be made to the embodiments described above without departing from the scope of the present disclosure. For example, while the embodiments described above refer to particular features, the scope of this disclosure also includes embodiments having different combinations of features and embodiments that do not include all of the above described features.

The following is claimed:

1. A faucet spout for delivering water, comprising:

an arm extending from an upstream portion to a downstream portion, the arm defining a longitudinal axis extending between the upstream portion and the downstream portion;

a passageway disposed in the arm and including an inlet configured to receive water from a water source, the inlet extending substantially parallel to the longitudinal axis;

a plurality of baffles disposed in the passageway and defining a tortuous flow path in the passageway; and an outlet disposed substantially perpendicularly to the longitudinal axis, the outlet configured to receive water from the passageway and deliver water from the faucet spout; and wherein each baffle of the plurality of baffles are disposed upstream from the outlet such that water is delivered in a substantially uniform flow from the outlet.

2. The faucet spout of claim 1, wherein the plurality of baffles comprises:

a first baffle having a first shape; and a second baffle having a second shape, the second shape being different than the first shape.

3. The faucet spout of claim 1, wherein the plurality of baffles comprises:

a plurality of first baffles each having a first shape; and a plurality of second baffles each having a second shape, the second shape being different than the first shape.

4. The faucet spout of claim 1, wherein at least some of the plurality of baffles comprise a common shape.

5. The faucet spout of claim 1, wherein the plurality of baffles comprises:

a first baffle comprising a first size; and a second baffle comprising a second size, the second size being larger than the first size.

6. The faucet spout of claim 1, wherein the plurality of baffles comprises:

at least one baffle disposed at the upstream portion; and an outlet baffle disposed at the downstream portion.

7. The faucet spout of claim 1, wherein the plurality of baffles are elongated in a transverse direction substantially perpendicular to the longitudinal axis.

8. The faucet spout of claim 7, wherein the plurality of baffles comprises:

a first baffle having a first upstream end and a first downstream end; and a second baffle having a second upstream end and a second downstream end, the second upstream end being offset from the first upstream end in a transverse direction and toward the outlet, the transverse direction being substantially perpendicular to the longitudinal axis.

9. The faucet spout of claim 8, wherein the plurality of baffles further comprises:

a third baffle having a third upstream end and a third downstream end, the third upstream end being offset from the second upstream end in the transverse direction and toward the outlet.

10. The faucet spout of claim 9, wherein the first upstream end, the second upstream end, and the third upstream end are offset according to a linear function.

11. The faucet spout of claim 8, further comprising a flow director disposed in the passageway, the flow director comprising an external surface carrying the plurality of baffles.

12. The faucet spout of claim 11, wherein the flow director further comprises a plurality of internal channels, the plurality of internal channels defining the tortuous path together with the plurality of baffles.

13. A faucet spout for delivering water, comprising:

a passageway having an inlet portion configured to receive water from a water source and an outlet portion configured to receive water from the inlet portion;

a longitudinal axis extending between the inlet portion and the outlet portion;

an outlet disposed substantially perpendicularly to the longitudinal axis, the outlet configured to receive water from the passageway and deliver water from the faucet spout;

a flow director disposed in the passageway and including a body having an outer surface, a plurality of baffles supported on the outer surface of the body, and an inner surface defining an internal passageway in fluid communication with the outlet, the flow director defining a tortuous flow path in the passageway, the tortuous flow path comprising:

a first segment in which water flows away from the outlet, the plurality of baffles defining the first segment of the tortuous path; and a second segment in which water is received from the first segment and water flows toward the outlet.

14. The faucet spout of claim 13, wherein the plurality of baffles are elongated in a transverse direction substantially perpendicular to the longitudinal axis.

15. The faucet spout of claim 14, wherein the plurality of baffles comprises:

a first baffle having a first upstream end and a first downstream end;

a second baffle having a second upstream end and a second downstream end, the second upstream end being offset from the first upstream end in a transverse direction and toward the outlet, the transverse direction being substantially perpendicular to the longitudinal axis; and a third baffle having a third upstream end and a third downstream end, the third upstream end being offset from the second upstream end in the transverse direction and toward the outlet.

16. The faucet spout of claim 15, wherein the first upstream end, the second upstream end, and the third upstream end are offset according to a linear function.

17. The faucet spout of claim 13, wherein the flow director further comprises an external surface carrying the plurality of baffles.

18. A faucet spout for delivering water, comprising:

a passageway having an inlet portion configured to receive water from a water source and an outlet portion configured to receive water from the inlet portion;

a longitudinal axis extending between the inlet portion and the outlet portion;

an outlet disposed substantially perpendicularly to the longitudinal axis, the outlet configured to receive water from the passageway and deliver water from the faucet spout;

a flow director disposed in the passageway and defining a tortuous flow path in the passageway, the tortuous flow path comprising:

a first segment in which water flows away from the outlet;

a second segment in which water is received from the first segment and water flows toward the outlet;

wherein the flow director comprises a plurality of baffles, the plurality of baffles defining the first segment of the tortuous path;

wherein the plurality of baffles are elongated in a transverse direction substantially perpendicular to the longitudinal axis; and, wherein the plurality of baffles comprises:

a first baffle having a first length in the transverse direction; and a second baffle having a second length in the transverse direction, the second length being greater than the first length.

19. The faucet spout of claim 18, wherein the first baffle is disposed between the inlet portion and the second baffle.

20. The faucet spout of claim 18, wherein the plurality of baffles further comprises:

a third baffle having a third length in the transverse direction, the third length being greater than the second length.

21. The faucet spout of claim 20, wherein the second baffle is disposed between the first baffle and the third baffle.

22. The faucet spout of claim 20, wherein the first length, the second length, and the third length differ according to a linear function.

23. A faucet spout for delivering water, comprising:

a passageway having an inlet portion configured to receive water from a water source and an outlet portion configured to receive water from the inlet portion;

a longitudinal axis extending between the inlet portion and the outlet portion;

an outlet disposed substantially perpendicularly to the longitudinal axis, the outlet configured to receive water from the passageway and deliver water from the faucet spout;

a flow director disposed in the passageway and defining a tortuous flow path in the passageway, the tortuous flow path comprising:

a first segment in which water flows away from the outlet;

a second segment in which water is received from the first segment and water flows toward the outlet;

wherein the flow director comprises a plurality of baffles, the plurality of baffles defining the first segment of the tortuous path;

wherein the flow director further comprises an external surface carrying the plurality of baffles; and wherein the external surface is an upper external surface and the plurality of baffles is a plurality of upper baffles, and wherein the flow director further comprises a lower external surface carrying a plurality of lower baffles.

24. A faucet spout for delivering water, comprising:

a passageway having an inlet portion configured to receive water from a water source and an outlet portion configured to receive water from the inlet portion;

a longitudinal axis extending between the inlet portion and the outlet portion;

an outlet disposed substantially perpendicularly to the longitudinal axis, the outlet configured to receive water from the passageway and deliver water from the faucet spout;

a flow director disposed in the passageway and defining a tortuous flow path in the passageway, the tortuous flow path comprising:

a first segment in which water flows away from the outlet;

a second segment in which water is received from the first segment and water flows toward the outlet;

wherein the flow director comprises a plurality of baffles, the plurality of baffles defining the first segment of the tortuous path;

wherein the flow director further comprises an external surface carrying the plurality of baffles; and wherein the flow director further comprises an internal surface defining an internal passageway, the passageway divided into a plurality of internal channels, the plurality of internal channels defining the second segment of the tortuous path.

25. The faucet spout of claim 24, wherein the flow director comprises a plurality of dividers defining the plurality of internal channels, the plurality of dividers comprising:

a first divider disposed in a first plane; and a second divider disposed in a second plane, the second plane being substantially parallel to the first plane.

26. The faucet spout of claim 24, wherein the flow director comprises a plurality of dividers defining the plurality of internal channels, the plurality of dividers comprising:

a first divider disposed in a first plane; and a second divider disposed in a second plane, the second plane being substantially perpendicular to the first plane.

27. The faucet spout of claim 24, wherein the plurality of baffles comprises a first baffle and a second baffle, and the flow director comprises a plurality of dividers defining the plurality of internal channels, the plurality of dividers comprising:

a first divider substantially aligned with the first baffle relative to the longitudinal axis; and a second divider substantially aligned with the second baffle relative to the longitudinal axis.

* * * * *